US006065300A

United States Patent [19]

Anthony

[11] Patent Number: 6,065,300

[45] Date of Patent: May 23, 2000

[54] SELF-COOLING CONTAINER WITH INTERNAL BEVERAGE VESSEL HAVING A VESSEL WALL WITH REVERSIBLE WALL BULGES

[76] Inventor: Michael M. Anthony, 10189 W. Sample Rd., Coral Spring, Fla. 33065

[21] Appl. No.: 09/246,859

[22] Filed: Feb. 8, 1999

[51] Int. Cl.[7] ..... F25D 3/08

[52] U.S. Cl. ..... 62/293; 29/455.1; 220/670

[58] Field of Search ..... 220/670, 671, 220/674, 720, 721; 62/293, 298, 372; 29/451, 455.1

[56] References Cited

U.S. PATENT DOCUMENTS

| | | | |
|---|---|---|---|
| 2,146,381 | 2/1939 | Rheem | 220/670 |
| 2,974,826 | 3/1961 | Martin | 220/670 |
| 4,211,208 | 7/1980 | Lindner | 220/720 |
| 5,178,289 | 1/1993 | Krishnakumar et al. | 220/674 |
| 5,865,036 | 2/1999 | Anthony | 62/293 |
| 5,946,930 | 9/1999 | Anthony | 62/293 |
| 5,964,021 | 2/1939 | Stoffel | 29/455.1 |

*Primary Examiner*—William E. Tapolcai

*Attorney, Agent, or Firm*—Oltman, Flynn & Kubler

[57] ABSTRACT

A rapid refrigeration apparatus includes a container having a container upper end, a container wall with a container opening in the container upper end bordered by a container rim; a beverage retaining vessel extending within the container defining an annular refrigerant chamber between the container and the vessel containing a liquefied refrigerant and refrigerant vapor, and the vessel containing flowable vessel contents, the vessel being sized to fit at least partly through the container opening, the vessel including a vessel rim secured relative to the container rim, and a vessel wall including at least one reversible bulge; a lid sealingly secured to the container rim and including a lid opener mechanism for releasing the vessel contents from the vessel and container for consumption; the lid opener mechanism including a lid opener mechanism activation mechanism for voluntarily opening the lid opener mechanism at a selected moment in time; and a refrigerant release mechanism for releasing the refrigerant from the annular chamber into the atmosphere surrounding the apparatus; the refrigerant release mechanism including a refrigerant release mechanism activation mechanism for voluntarily opening the refrigerant release mechanism at a selected moment in time.

12 Claims, 23 Drawing Sheets

SELF-COOLING CONTAINER WITH INTERNAL BEVERAGE VESSEL HAVING A VESSEL WALL WITH REVERSIBLE WALL BULGES

BACKGROUND OF THE INVENTION

1. Field of the Invention

The present invention relates generally to the field of beverage containers. More specifically the present invention relates to a self-cooling container apparatus containing a beverage or other food item and to methods of assembling and operating the apparatus. The terms "vessel contents", "food item" and "beverage" are considered equivalent for purposes of this application and are used interchangeably.

For the first preferred embodiment, the apparatus includes an outer container in the form of a can or bottle having a conventional unified bottom and side container wall terminating in an upper sealing flange referred to hereinafter as a container rim. A beverage retaining secondary vessel is provided within the container including a unified bottom and side vessel wall having at least one reversible bulge which protrudes inwardly to permit close fitting vessel insertion into the container during manufacture and which is caused to protrude outwardly after such insertion to maximize beverage retaining capacity and to increase vessel heat transfer surface area. The vessel has a vessel sealing flange, hereinafter referred to as a vessel rim, which extends laterally from the vessel wall and rests on top of the container rim. A narrow annular refrigerant chamber is defined between the container wall and vessel wall containing a refrigerant such as mixtures of hydrocarbons. Several reversible bulges are preferably provided.

2. Description of the Prior Art

There have previously been self-cooling containers for food items, these containers including refrigerant receptacles with widely spaced apart, rigid receptacle walls. The receptacle is opened when cooling is desired and the refrigerant is progressively discharged from the receptacle, extracting heat from the vessel contents. Problems with this construction have been high container expense, less than maximized heat transfer surface area and less than maximized beverage capacity.

It is thus an object of the present invention to provide a self-cooling container apparatus including an external container and an internal vessel for retaining a liquid food item, the container and vessel defining between them a refrigerant chamber with large heat transfer surface area and including beverage release means and an annular refrigerant release means.

It is another object of the present invention to provide such an apparatus in which regions of the internal vessel are configured as reversible bulges caused to protrude into the vessel for compact insertion into the external container and caused to protrude outwardly after such insertion to maximize beverage retaining capacity and to increase vessel heat transfer surface area.

It is still another object of the present invention to provide such an apparatus in which the refrigerant release means is simple and easy to use and in which the beverage release means cannot be manually operated until the refrigerant is released, and which shields surfaces over which the beverage flows during pouring against contamination.

It is a still further object of the invention to provide such an apparatus which functions as a thermos after refrigerant release and resultant beverage cooling, by defining an inner vessel spaced apart by an empty annular refrigerant chamber from the outer container, so that beverage not consumed immediately is kept cool while the outside of the container is a comfortably maintained at ambient temperature.

It is finally an object of the present invention to provide such an apparatus which is relatively inexpensive to manufacture, safe and easy to use.

SUMMARY OF THE INVENTION

The present invention accomplishes the above-stated objectives, as well as others, as may be determined by a fair reading and interpretation of the entire specification.

A rapid refrigeration apparatus is provided including a container having a container upper end, a container wall with a container opening in the container upper end bordered by a container rim; a beverage retaining vessel extending within the container defining an annular refrigerant chamber between the container and the vessel containing a refrigerant, and the vessel containing liquid vessel contents, the vessel being sized to fit at least partly through the container opening, the vessel including a vessel rim secured relative to the container rim, and a vessel wall including at least one reversible bulge; a lid sealingly secured to the container rim and including a lid opener mechanism for releasing the vessel contents from the vessel and container for consumption; the lid opener mechanism including a lid opener mechanism activation mechanism for voluntarily opening the lid opener mechanism at a selected moment in time; and a refrigerant release mechanism for releasing the refrigerant gas or vapor from the annular liquified refrigerant chamber into the atmosphere surrounding the apparatus; the refrigerant release mechanism including a refrigerant release mechanism activation mechanism for voluntarily opening the refrigerant release mechanism at a selected moment in time.

The lid has a lid interior surface and a lid exterior surface and the lid opener mechanism preferably includes a lid beverage port; a trap door in the general shape of an inverted dish having a door interior surface and a door exterior surface, sized and positioned to fit into the lid beverage port and having a radially extending door lip for making sealing abutment with the interior surface of the lid surrounding the lid beverage port and a door pivot arm having an arm fulcrum end and extending along the interior surface of the lid to the arm fulcrum end, the arm fulcrum end being connected to the lid with door fastening mechanism; where the trap door is held in sealing relationship with the lid at least in part by the pressure of the refrigerant bearing against the vessel which is transmitted through the vessel contents to bear against the interior surface of the door, pressing the radially extending lip against the lid interior surface, and where the pressure of the vessel contents against the door interior surface is of a magnitude that prevents the user from readily opening the trap door until after the release of the refrigerant through the refrigerant release mechanism.

The door fastening mechanism preferably includes a cup-shaped arm bulge in the pivot arm which is press-fitted into a cup-shaped lid bulge, so that no rivet passing opening is provided through which the refrigerant might escape. The lid opener mechanism preferably additionally includes stretchable sanitizing tape adhesively secured over and onto the exterior surface of the trap door and preferably extends over the lid near the beverage port, where the tape readily stretches to permit the trap door to be depressed into the container with minimal resistance; so that the tape permits the user to open the trap door with dirty fingers and then, upon removal of the tape together with any dirt deposited onto it, to pour beverage out of the container over a clean trap door.

The refrigerant release mechanism is preferably located at the center of the bottom portion of the container wall, the bottom portion being sufficiently concave to prevent contact of the refrigerant release mechanism with a container support surface such as a table. The refrigerant release mechanism preferably includes a mounting port in the container wall bottom portion fitted with a plug structure having a plug cylindrical portion fitted longitudinally into the mounting port and having a lateral plug radial flange extending sealingly over the interior surface of the container wall bottom portion around the mounting port, the plug structure having an axial bore closed by a dam wall; and a puncturing structure including a head portion and a tubular needle portion extending from the head portion, the needle portion having a sharpened needle free end defining an axial refrigerant passageway opening through the head portion; where the needle portion fits into the axial bore and is of sufficient length that the sharpened free end of the needle portion can abut the dam wall while the disk head portion is spaced apart from the plug cylindrical portion; so that manual pressure applied by a user drives the head portion against the plug cylindrical portion and drives the needle portion piercingly through the dam wall so that the liquified refrigerant evaporates and the resultant refrigerant gas escapes into the atmosphere surrounding the apparatus through the axial bore. The apparatus preferably additionally includes at least one longitudinally extending needle portion guide spline slidably retained within a longitudinally extending cylindrical portion guide slot.

A rapid refrigeration apparatus is further provided including a container having a container upper end, a container wall with a container opening in the container upper end bordered by a container rim and a beverage retaining vessel extending within the container defining an annular liquified refrigerant chamber between the container and the vessel containing a liquid refrigerant and refrigerant vapor, and the vessel containing flowable vessel contents; a lid sealingly secured to the container rim and including a lid opener mechanism for releasing the vessel contents from the vessel and container for consumption; the lid opener mechanism including a lid opener mechanism activation mechanism for voluntarily opening the lid opener mechanism at a selected moment in time, where the lid has a lid interior surface and a lid exterior surface and where the lid opener mechanism includes a lid beverage port; a trap door in the general shape of an inverted dish having a door interior surface and a door exterior surface, sized and positioned to fit into the lid beverage port and having a radially extending door lip for making sealing abutment with the interior surface of the lid surrounding the lid beverage port and a door pivot arm having an arm fulcrum end and extending along the interior surface of the lid to the arm fulcrum end, the arm fulcrum end being connected to the lid with a door fastening mechanism, where the trap door is held in sealing relationship with the lid at least in part by the pressure of the liquified refrigerant and refrigerant gas or vapor against the vessel which is transmitted to and through the vessel contents to the interior surface of the door, pressing the radially extending lip against the lid interior surface, and where the pressure of the vessel contents against the door interior surface is of a magnitude that prevents the user from opening the trap door until after the release of the refrigerant through the refrigerant release mechanism; and a refrigerant release mechanism for releasing the refrigerant from the annular chamber into the atmosphere surrounding the apparatus; the refrigerant release mechanism including a refrigerant release mechanism activation mechanism for voluntarily opening the refrigerant release mechanism at a selected moment in time.

A rapid refrigeration apparatus is still further provided, including a container having a container upper end, a container wall with a container opening in the container upper end bordered by a container rim; a beverage retaining vessel extending within the container defining an annular refrigerant chamber between the container and the vessel containing a refrigerant, and the vessel containing liquid vessel contents; a lid sealingly secured to the container rim and including a lid opener mechanism for releasing the vessel contents from the vessel and container for consumption; the lid opener mechanism including a lid opener mechanism activation mechanism for voluntarily opening the lid opener mechanism at a selected moment in time; and a refrigerant release mechanism for releasing the refrigerant from the annular chamber into the atmosphere surrounding the apparatus; the refrigerant release mechanism including a mounting port in the container wall bottom portion fitted with a plug structure having a plug cylindrical portion fitted longitudinally into the mounting port and having a lateral plug radial flange extending sealingly over the interior surface of the container wall bottom portion around the mounting port, the plug structure having an axial bore closed by a dam wall, and a puncturing structure including a head portion and a tubular needle portion extending from the head portion, the needle portion having a sharpened needle free end defining an axial refrigerant passageway opening through the head portion; where the needle portion fits into the axial bore and is of sufficient length that the sharpened free end of the needle portion can abut the dam wall while the disk head portion is spaced apart from the plug cylindrical portion; so that manual pressure applied by a user drives the head portion against the plug cylindrical portion and drives the needle portion piercingly through the dam wall so that the liquified refrigerant boils into refrigerant gas which escapes into the atmosphere surrounding the apparatus through the axial bore thereby cooling the vessel contents.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
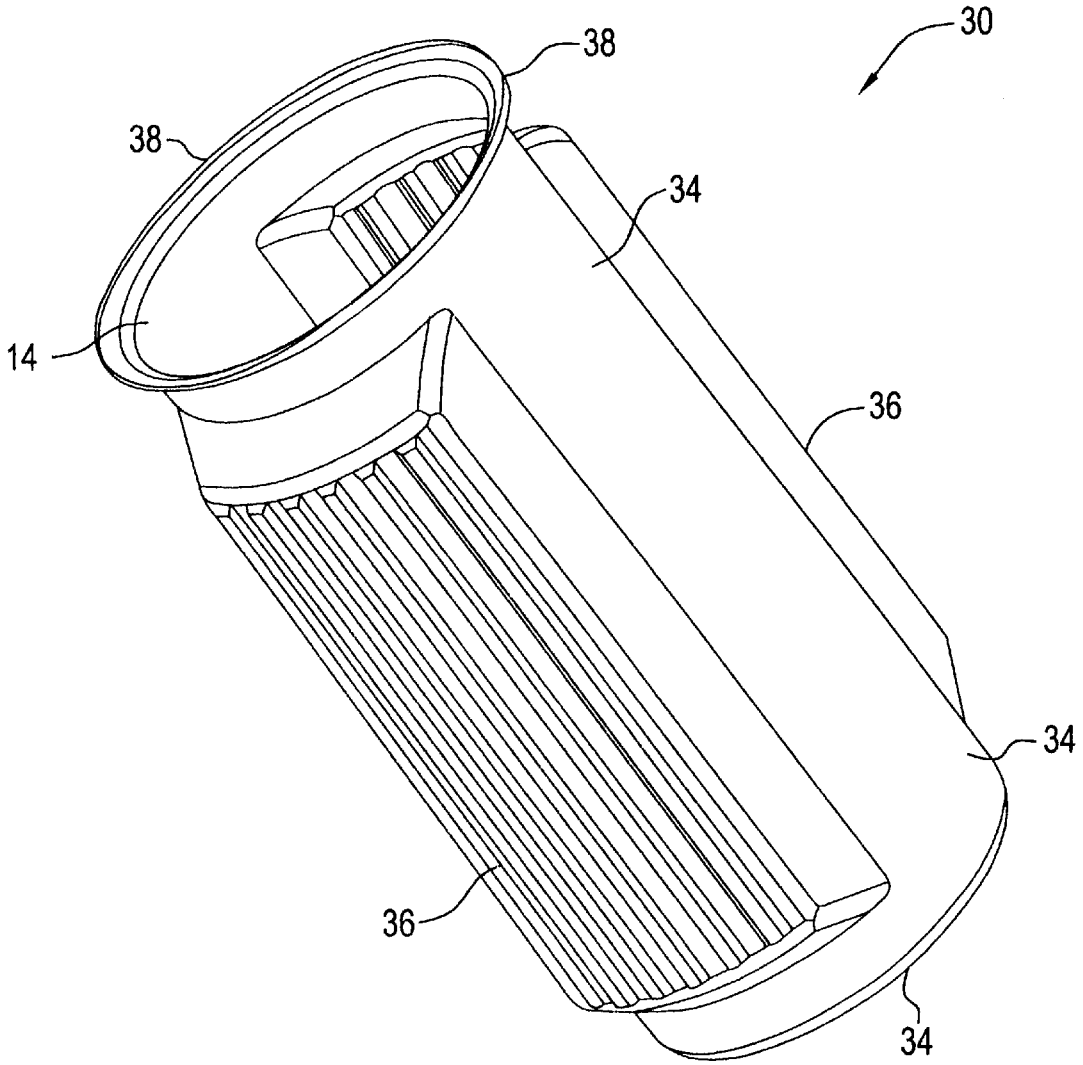
FIG. 1 is a perspective view of one embodiment of the beverage containing, internal vessel showing one possible reversible bulge configuration in the outwardly protruding mode.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
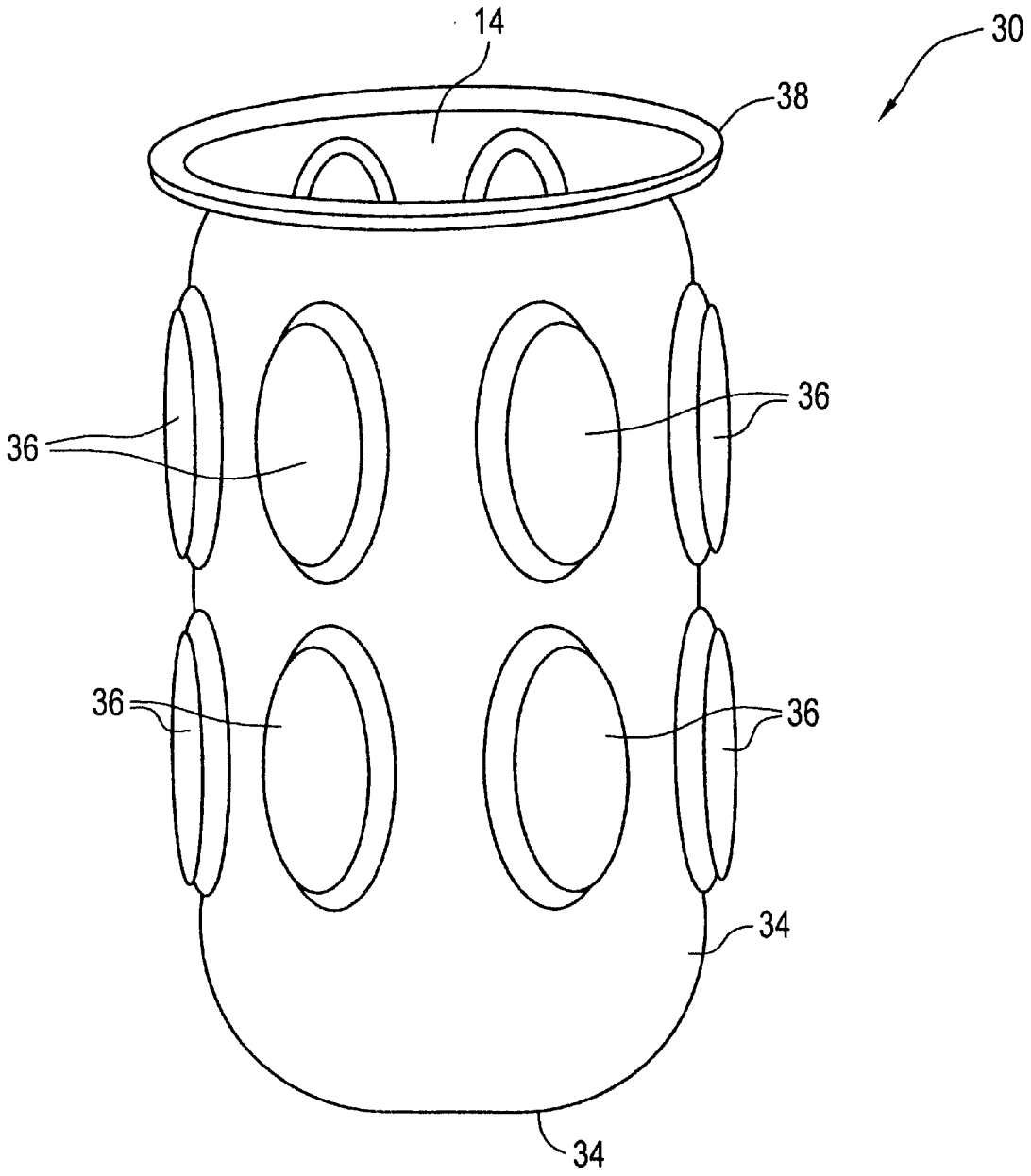
FIG. 2 is a view substantially as in FIG. 1, showing another reversible bulge configuration in the outwardly protruding mode.
Figure 3:
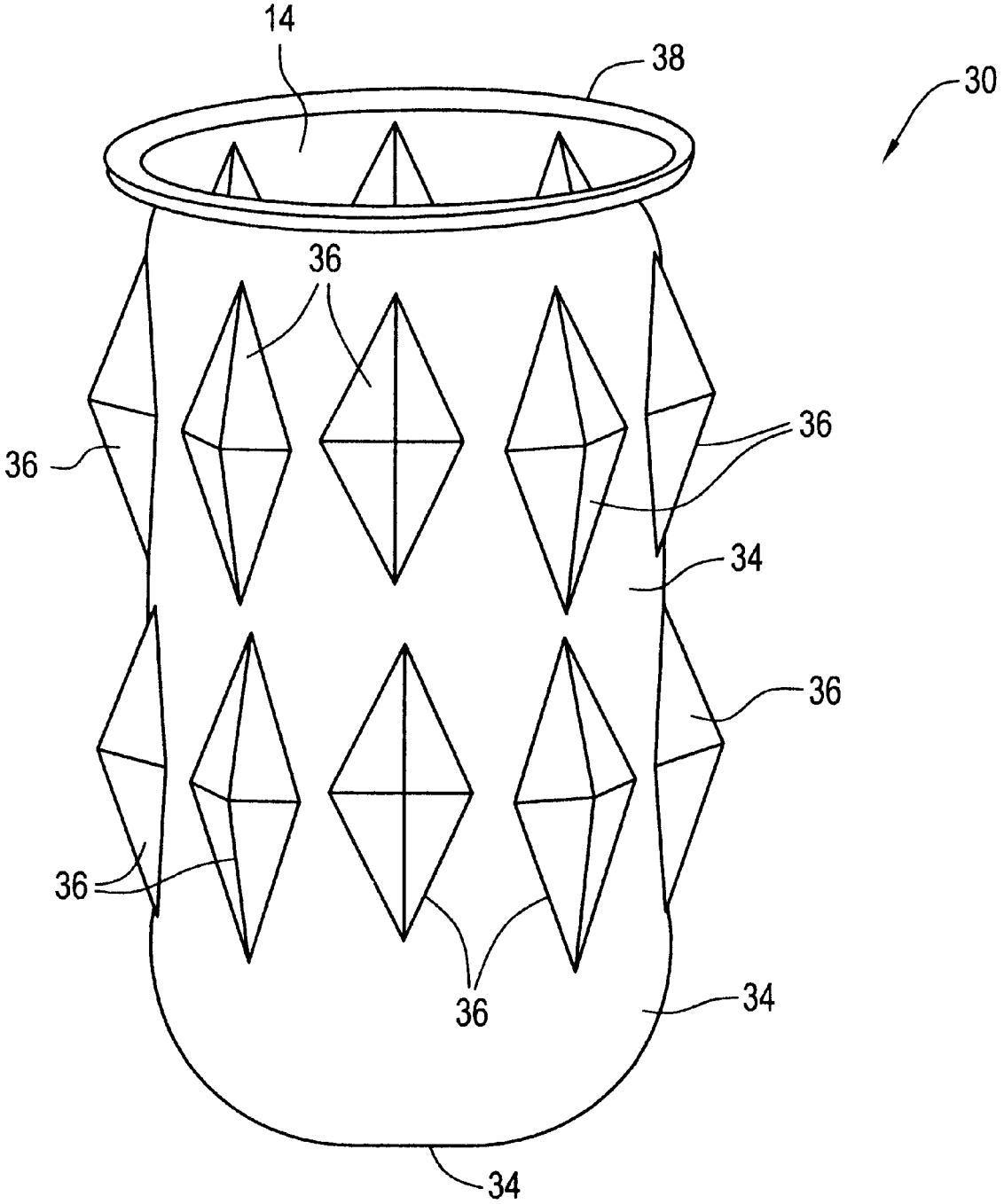
FIG. 3 is a view substantially as in FIG. 1, showing still another reversible bulge configuration in the outwardly protruding mode.
Figure 4:
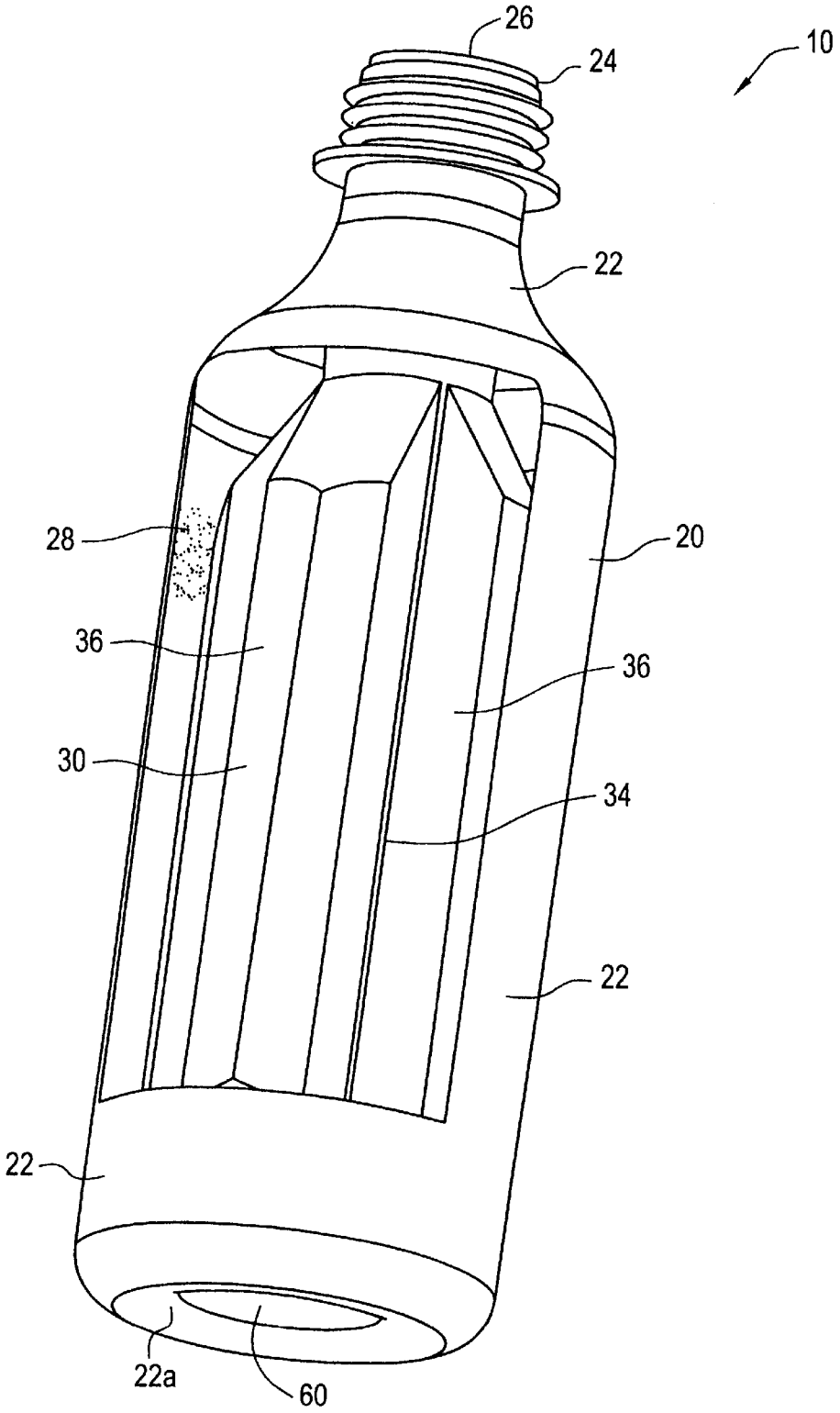
FIG. 4 is a cut-away view of the inventive apparatus in the form of a bottle shaped external container, revealing the internal vessel, and showing part of the refrigerant annular chamber.
Figure 5:
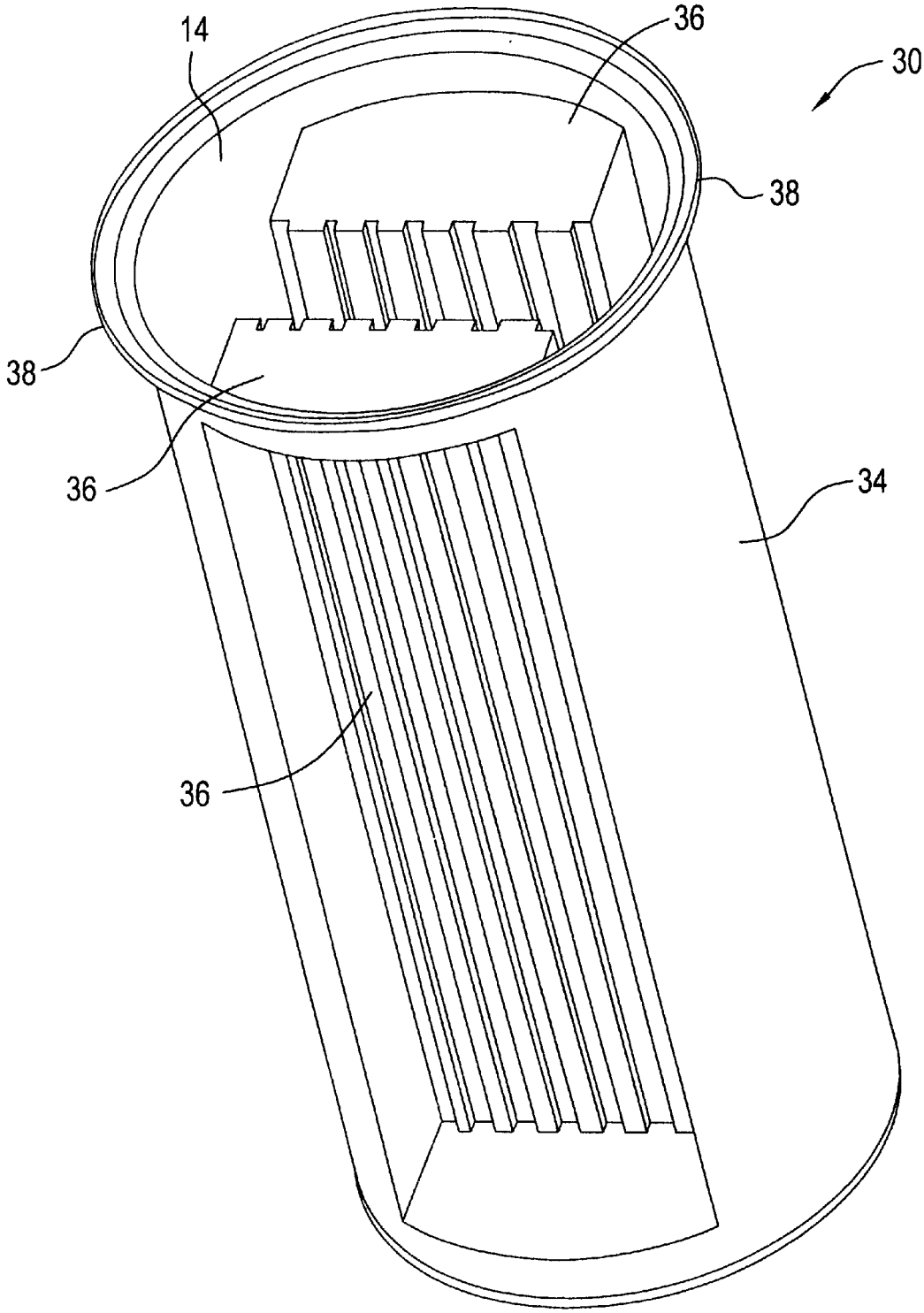
FIG. 5 is a view of the vessel shown in FIG. 1, with the reversible bulges reversed to protrude inwardly for insertion of the vessel into a container.
Figure 6:
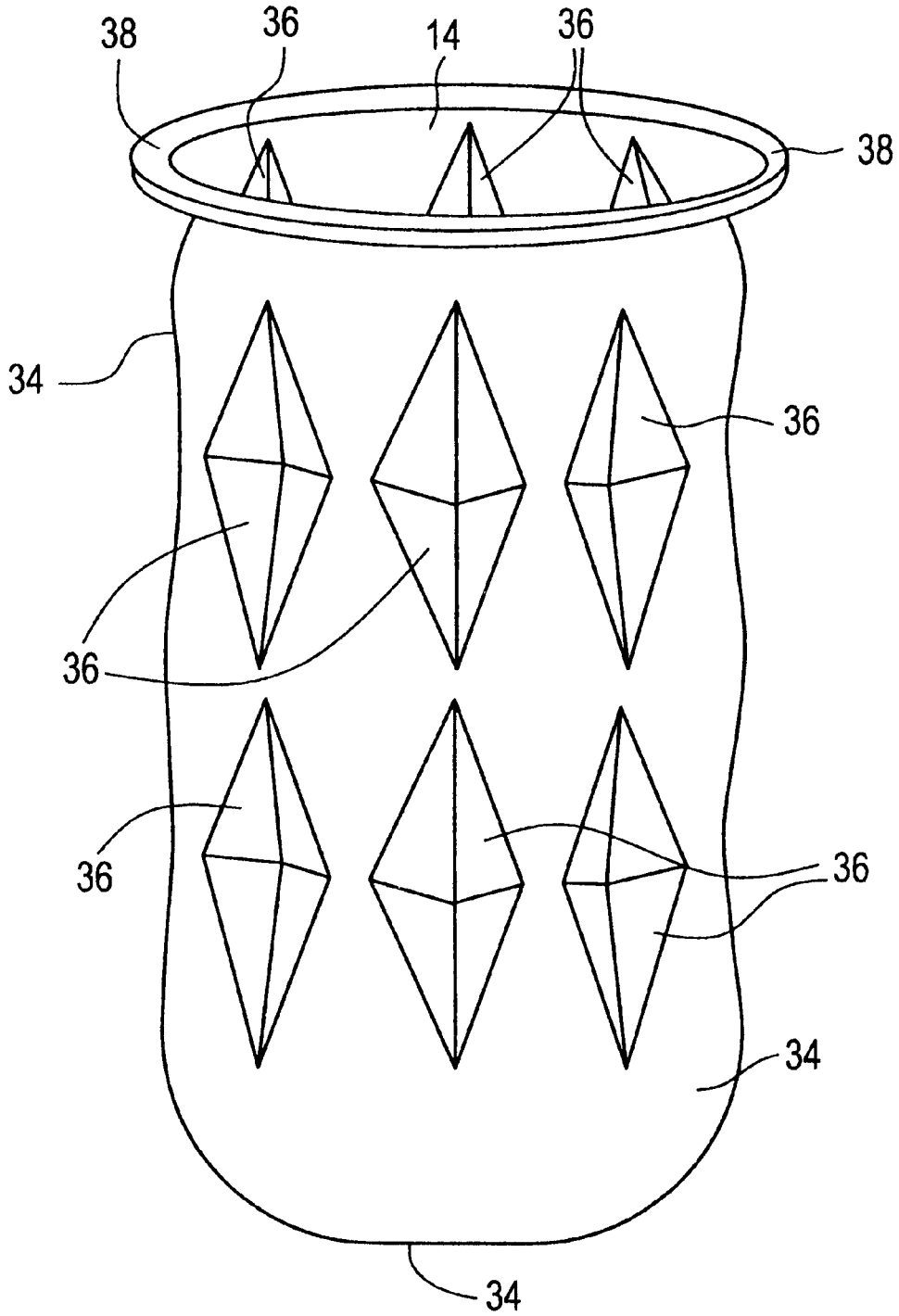
FIG. 6 is a view of the vessel shown in FIG. 3, with the reversible bulges reversed to protrude inwardly.
Figure 7:
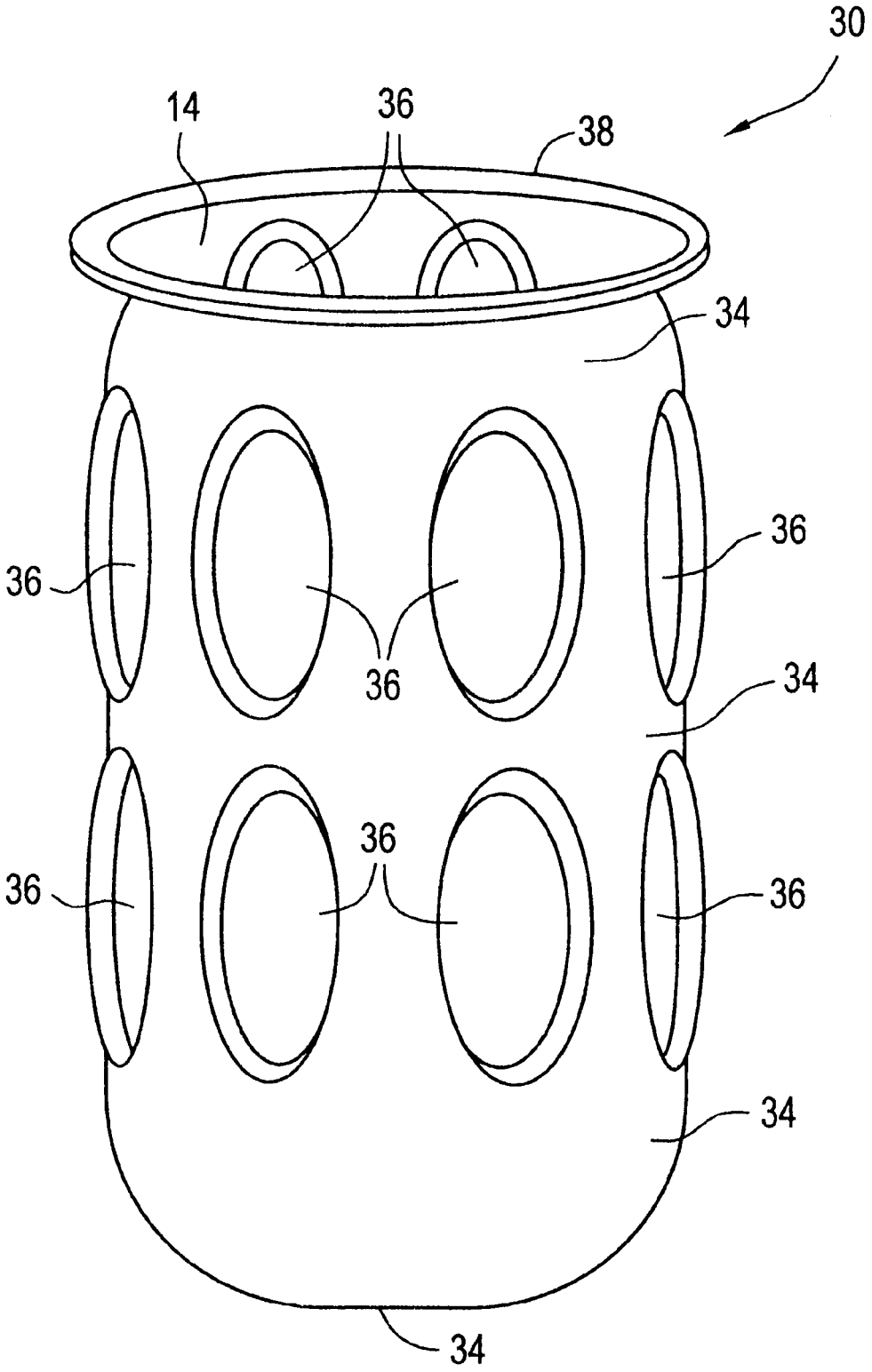
FIG. 7 is a view of the vessel shown in FIG. 2, with the reversible bulges reversed to protrude inwardly.
Figure 8:
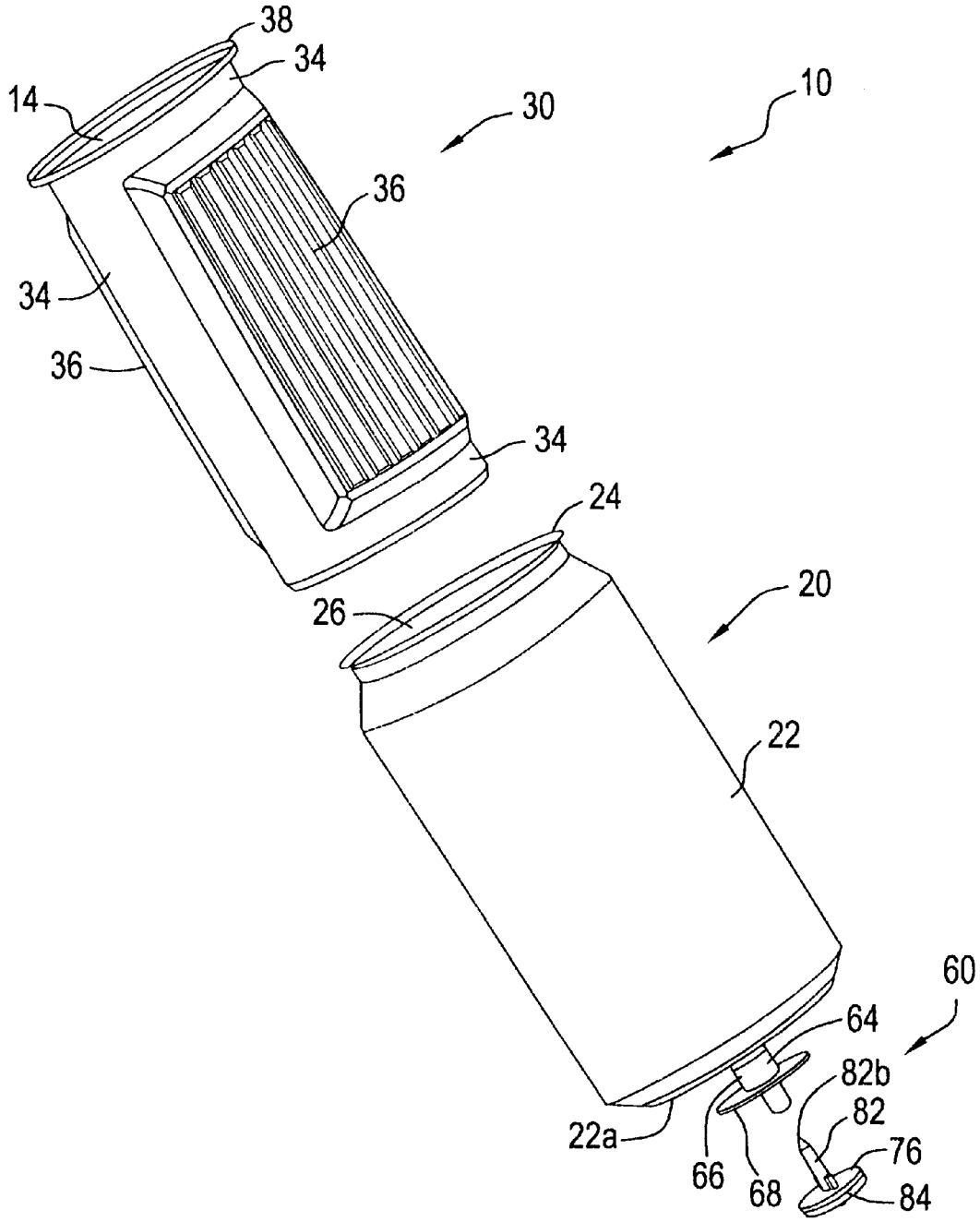
FIG. 8 is a perspective side view of a vessel as in FIG. 1 positioned for insertion into the external container and the refrigerant release mechanism elements positioned for engagement in the container bottom wall portion. The reversible bulges must be reversed to protrude inwardly before such insertion.
Figure 9:
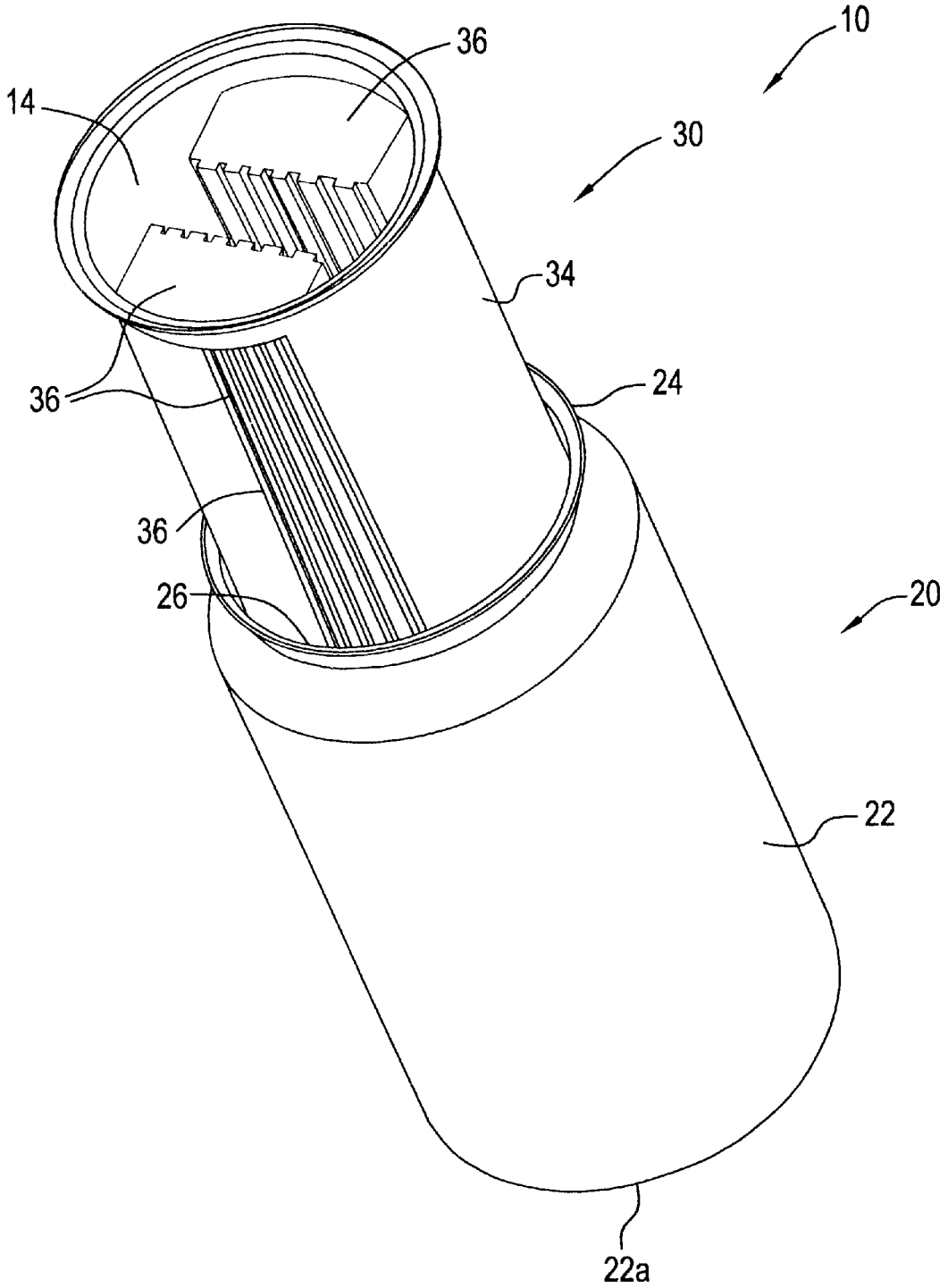
FIG. 9 is a view substantially as in FIG. 8, with the reversible bulges reversed and the vessel partly inserted into the external container. The preferred close fit of the vessel into the container opening with bulges directed inwardly.
Figure 10:
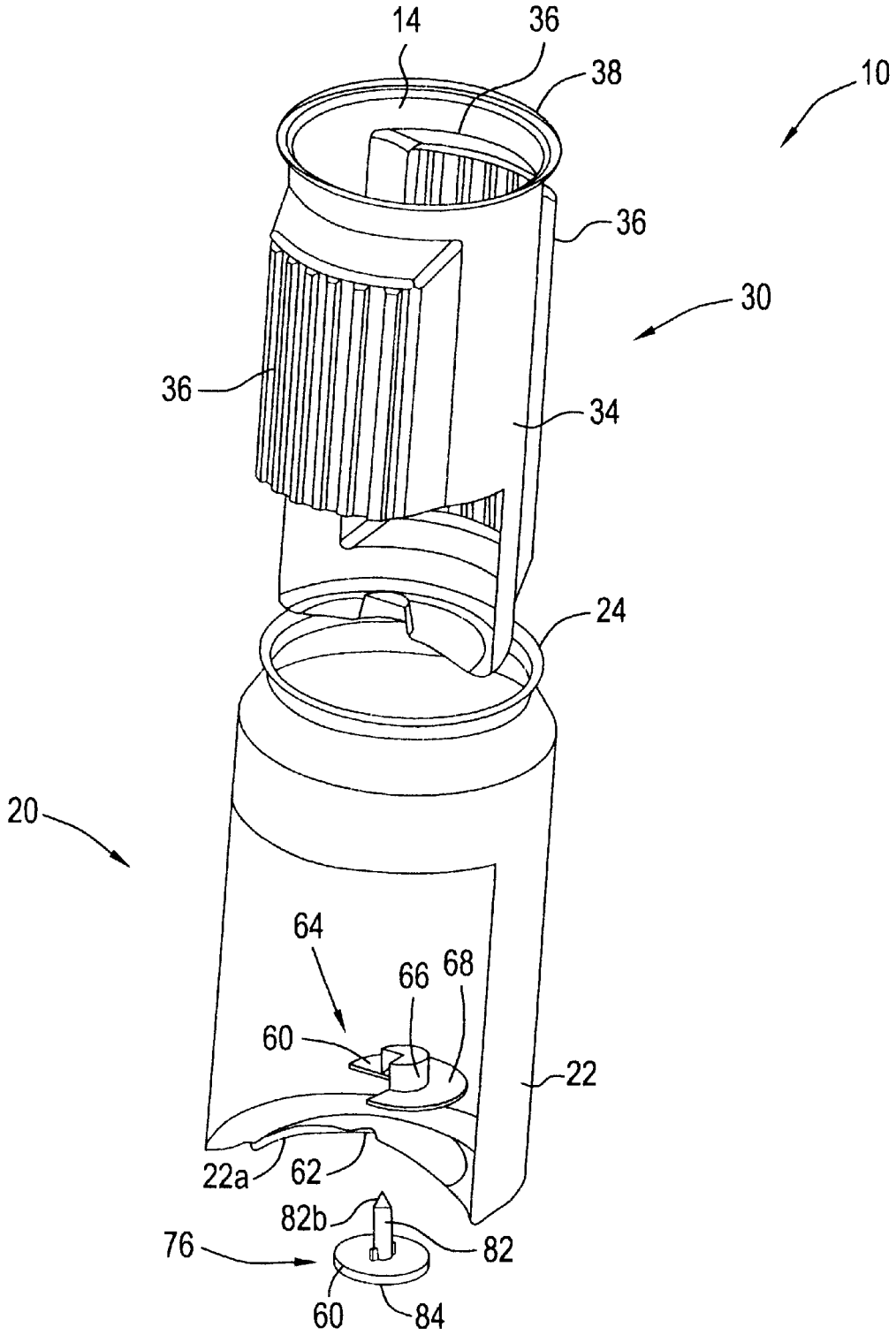
FIG. 10 is a view substantially as in FIG. 8, with a portion of the vessel lower side wall cut away to reveal the plug structure receiving well formed in the vessel bottom wall portion, and with the lower container side wall cut away to reveal the plug structure loosely positioned above the mounting port and showing the puncturing structure below the container.
Figure 11:
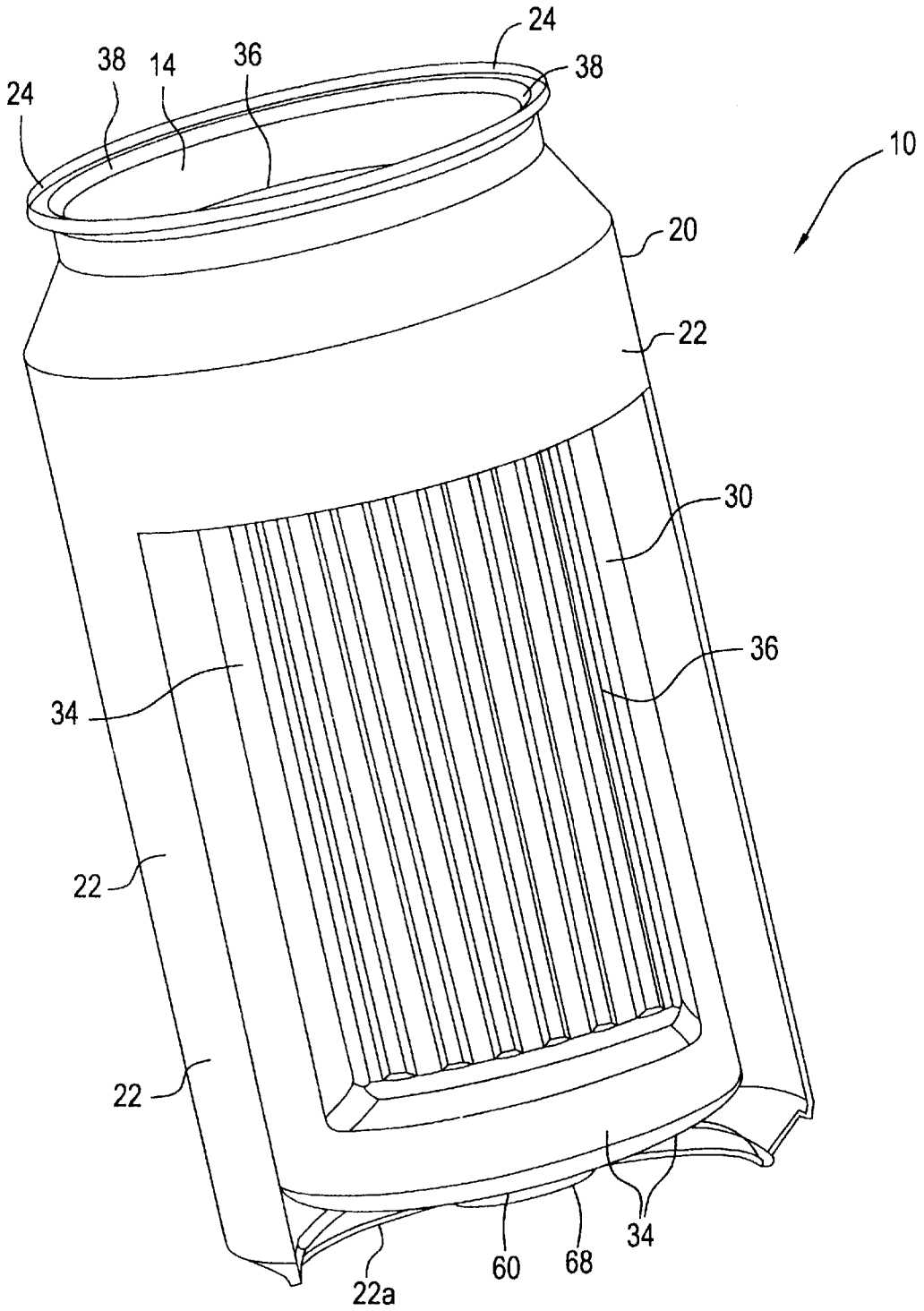
FIG. 11 is a side view of the apparatus with a portion of the container side wall cut away to reveal the vessel with the bulges protruding inwardly.
Figure 12:
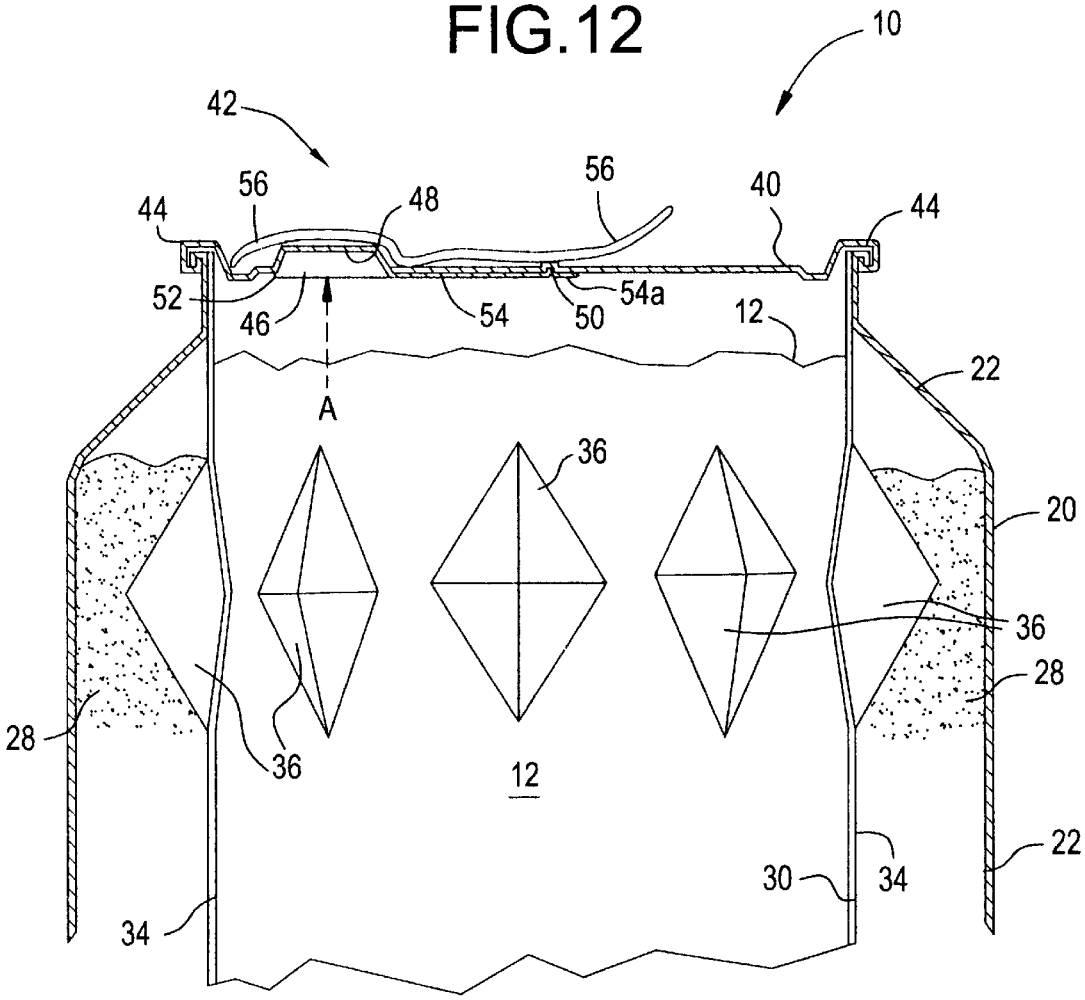
FIG. 12 is a partial, top cross-sectional view of the apparatus, revealing the outwardly protruding reversible bulges, the liquid refrigerant with gaseous refrigerant above it in the annular refrigerant chamber, and the lid opener mechanism in its unopened mode with the protective tape cover it.
Figure 13:
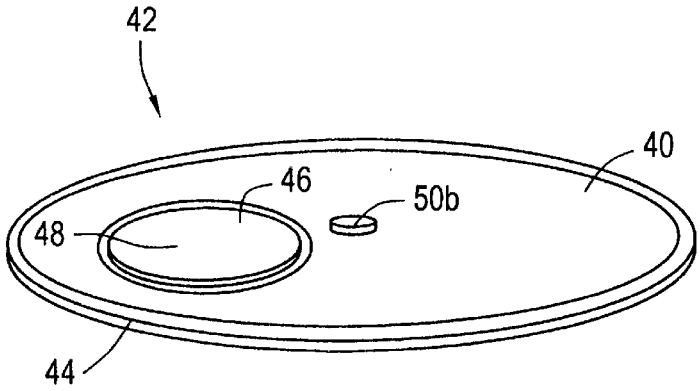
FIG. 13 is a perspective upper view of the lid and lid opener mechanism, with the trap door closed.
Figure 14:
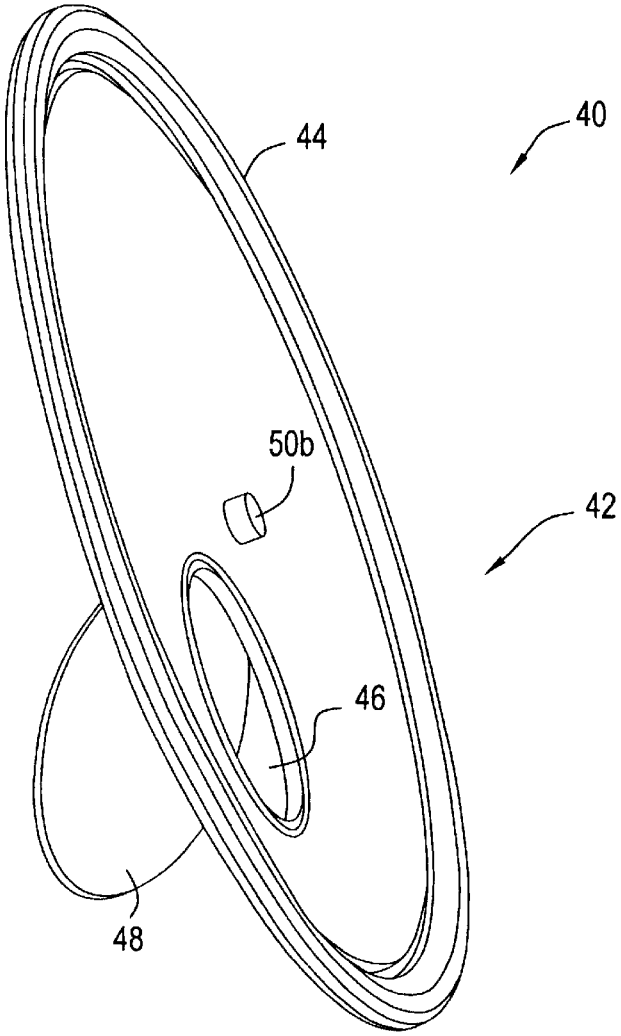
FIG. 14 is a view as in FIG. 13, with the lid rotated ninety degrees and the trap door open.
Figure 15:
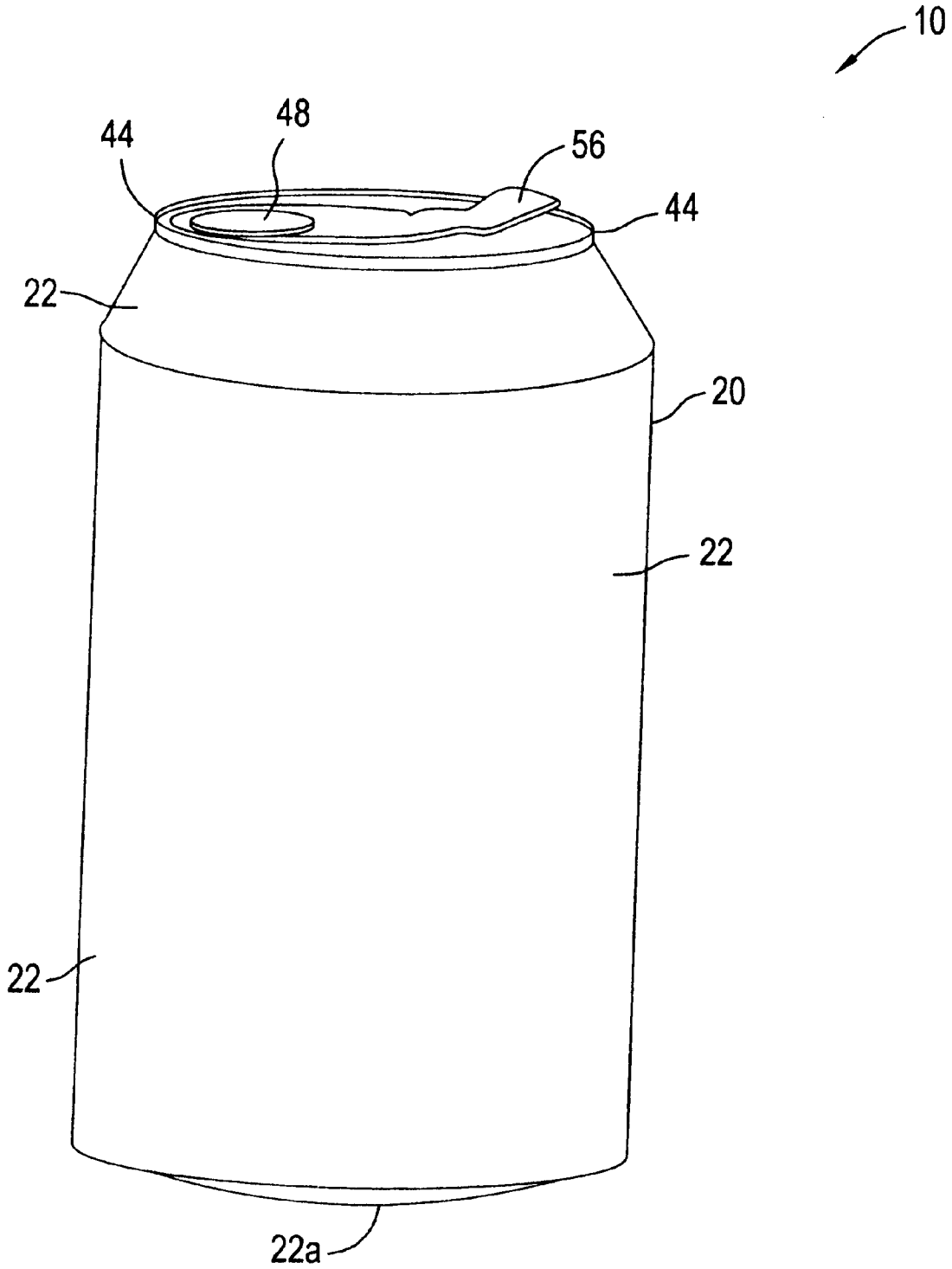
FIG. 15 is a full, perspective side view of the apparatus in its filled, finished, closed form, ready for use.
Figure 16:
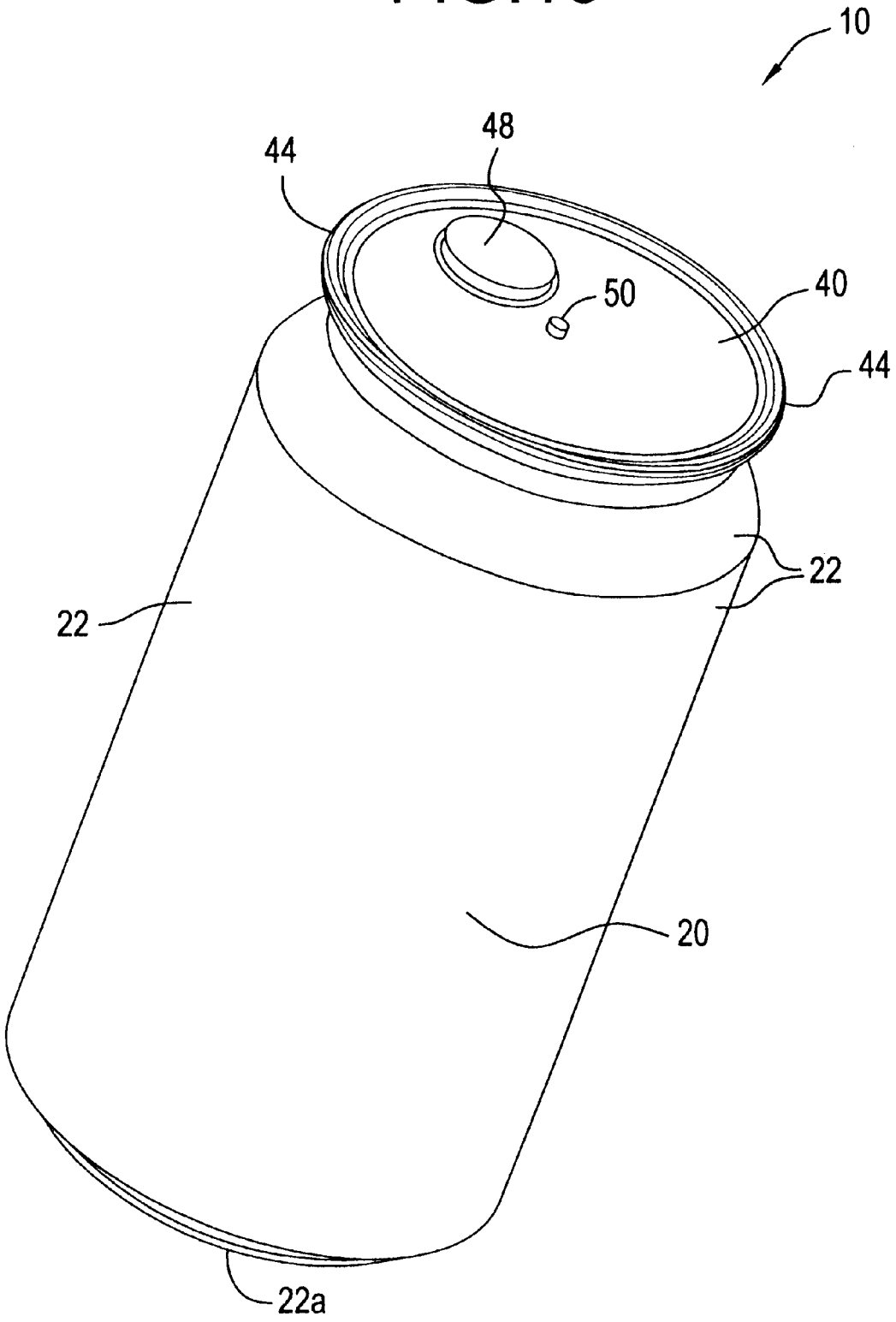
FIG. 16 is a view as in FIG. 15, angled to more fully reveal the lid and lid opener structure.
Figure 17:
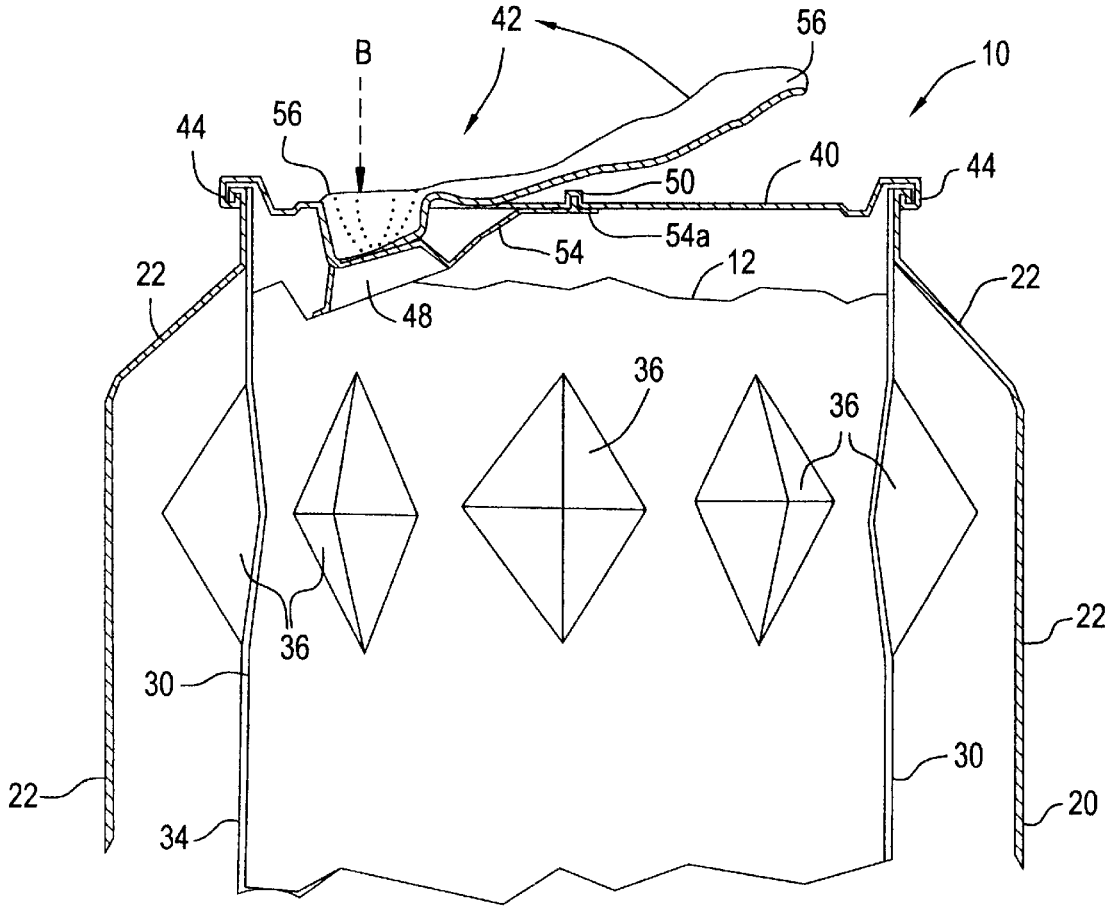
FIG. 17 is a view as in FIG. 12, with the lid trap door pivoted into an open position, following release of the refrigerant.
Figure 18:
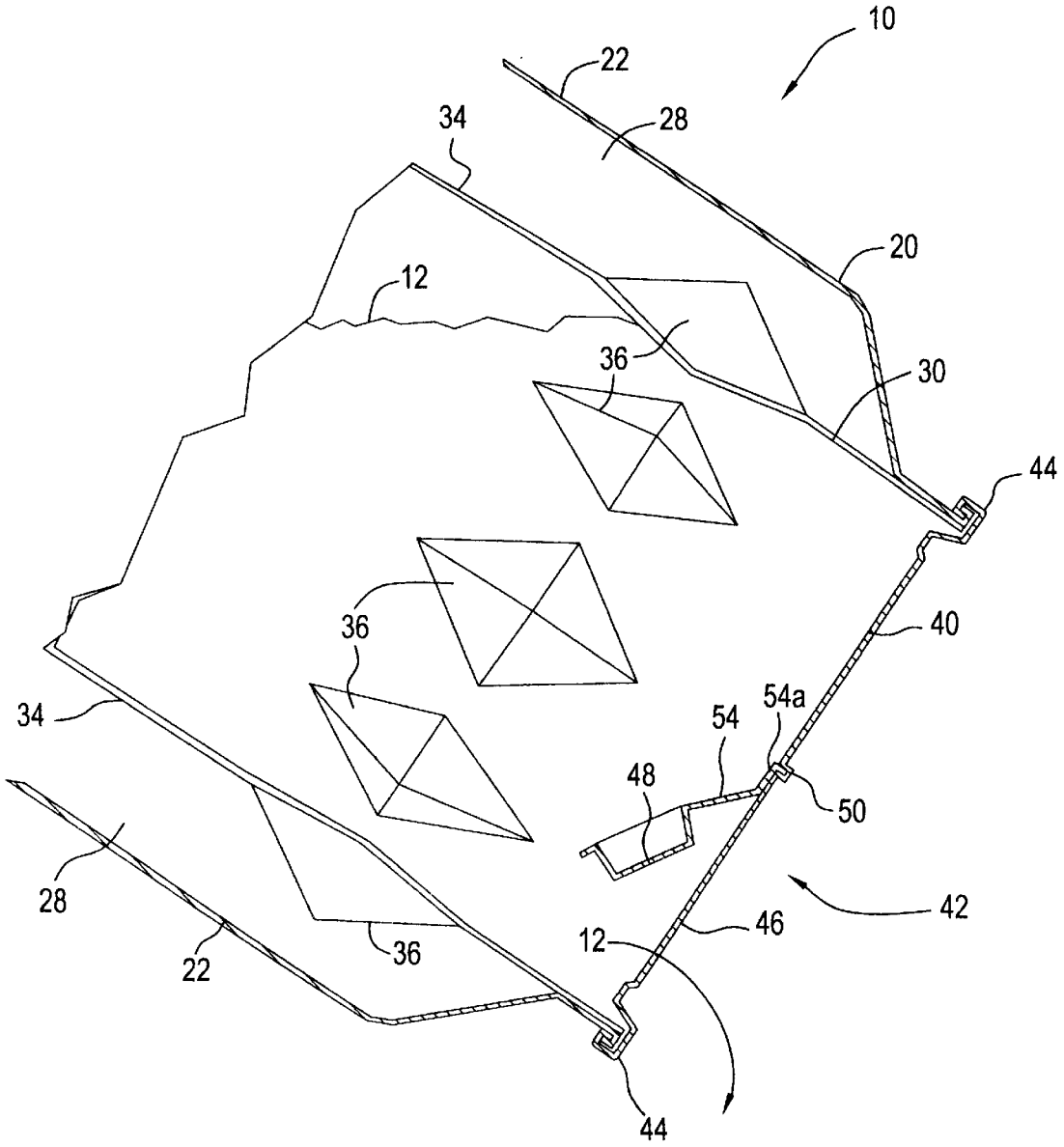
FIG. 18 is a view as in FIG. 17, with the apparatus partly inverted and the beverage vessel contents pouring out of the lid opener mechanism.
Figure 19:
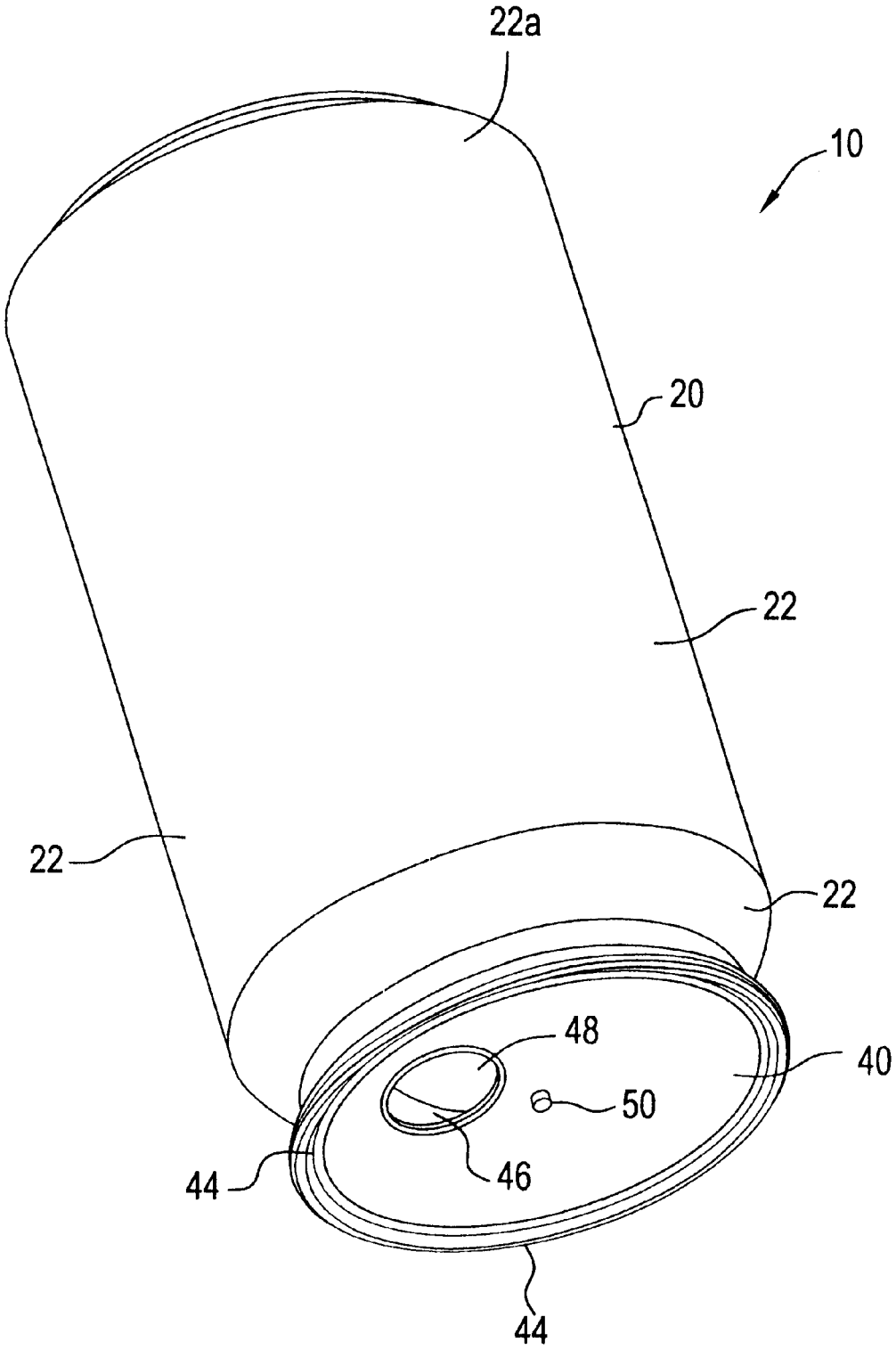
FIG. 19 is a full view of the inverted apparatus of FIG. 18, showing the trap door open.
Figure 20:
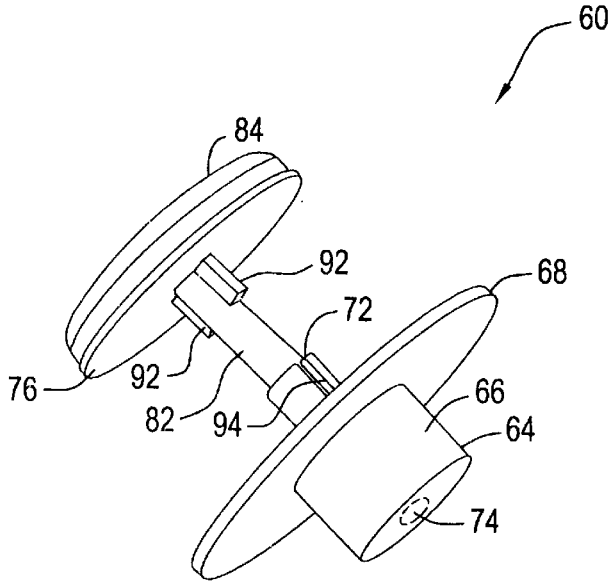
FIG. 20 is a perspective of the refrigerant release mechanism by itself, showing its various element up close.
Figure 21:
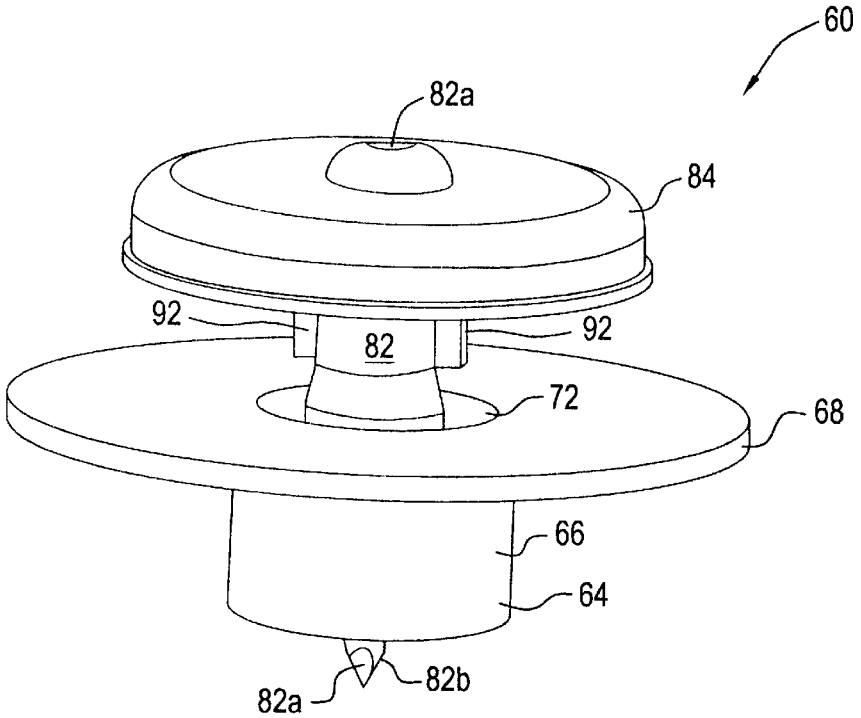
FIG. 21 is a view generally as in FIG. 20, with the tubular needle piercing the dam wall for refrigerant release.
Figure 22:
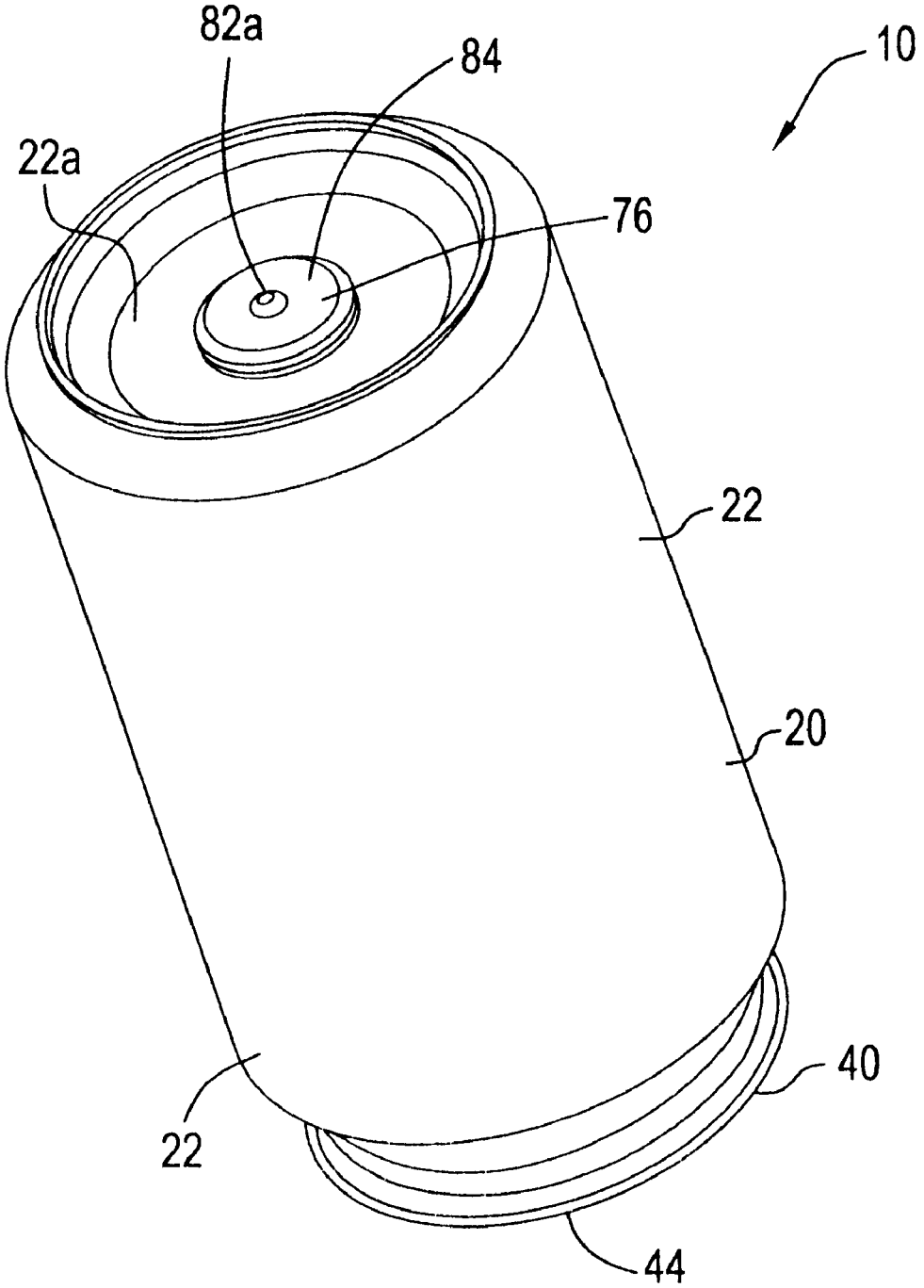
FIG. 22 is a perspective view of the inverted apparatus, showing the container bottom wall portion and the depressed piercing element.
Figure 23:
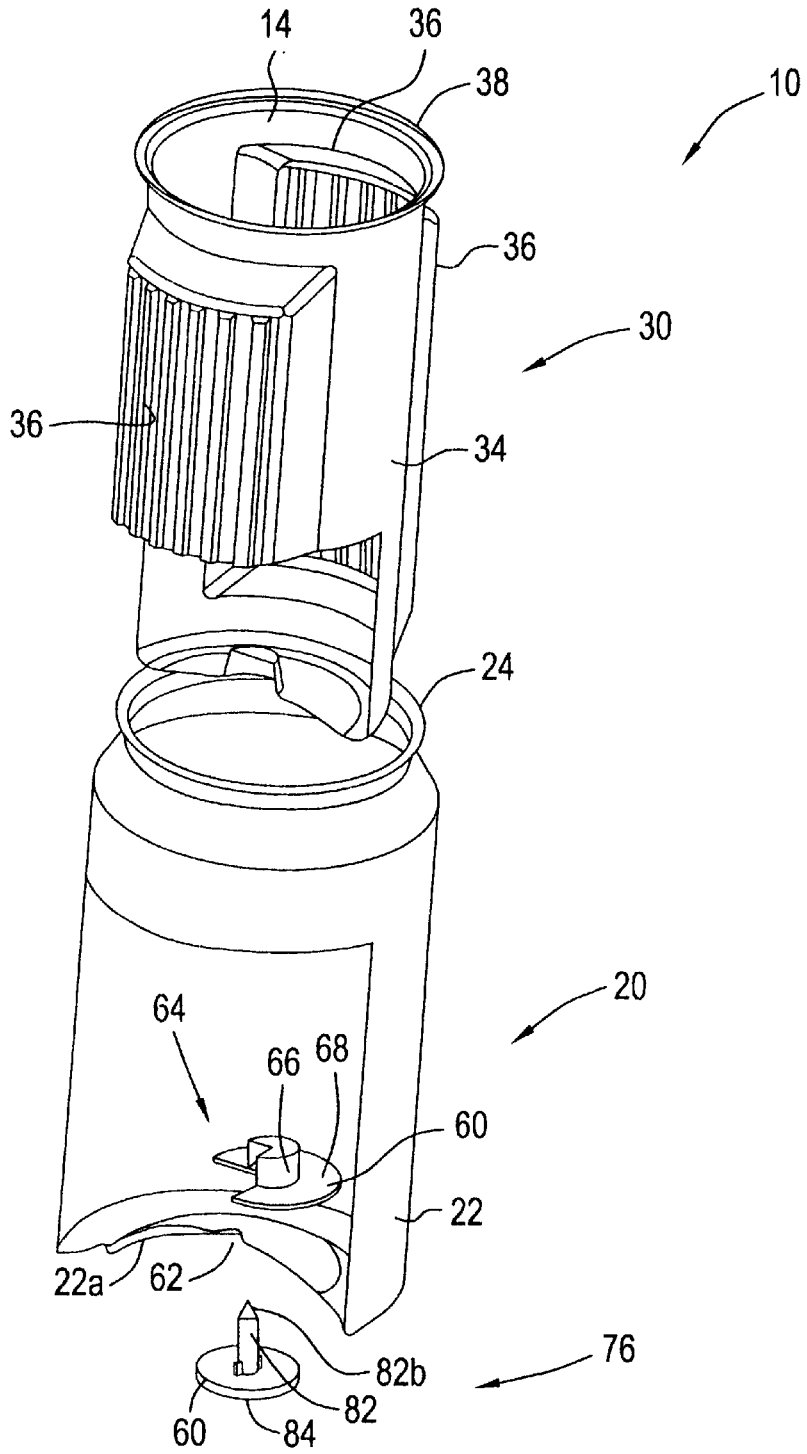
FIG. 23 is view as in FIG. 10, shown again for progression in the written description.
Figure 24:
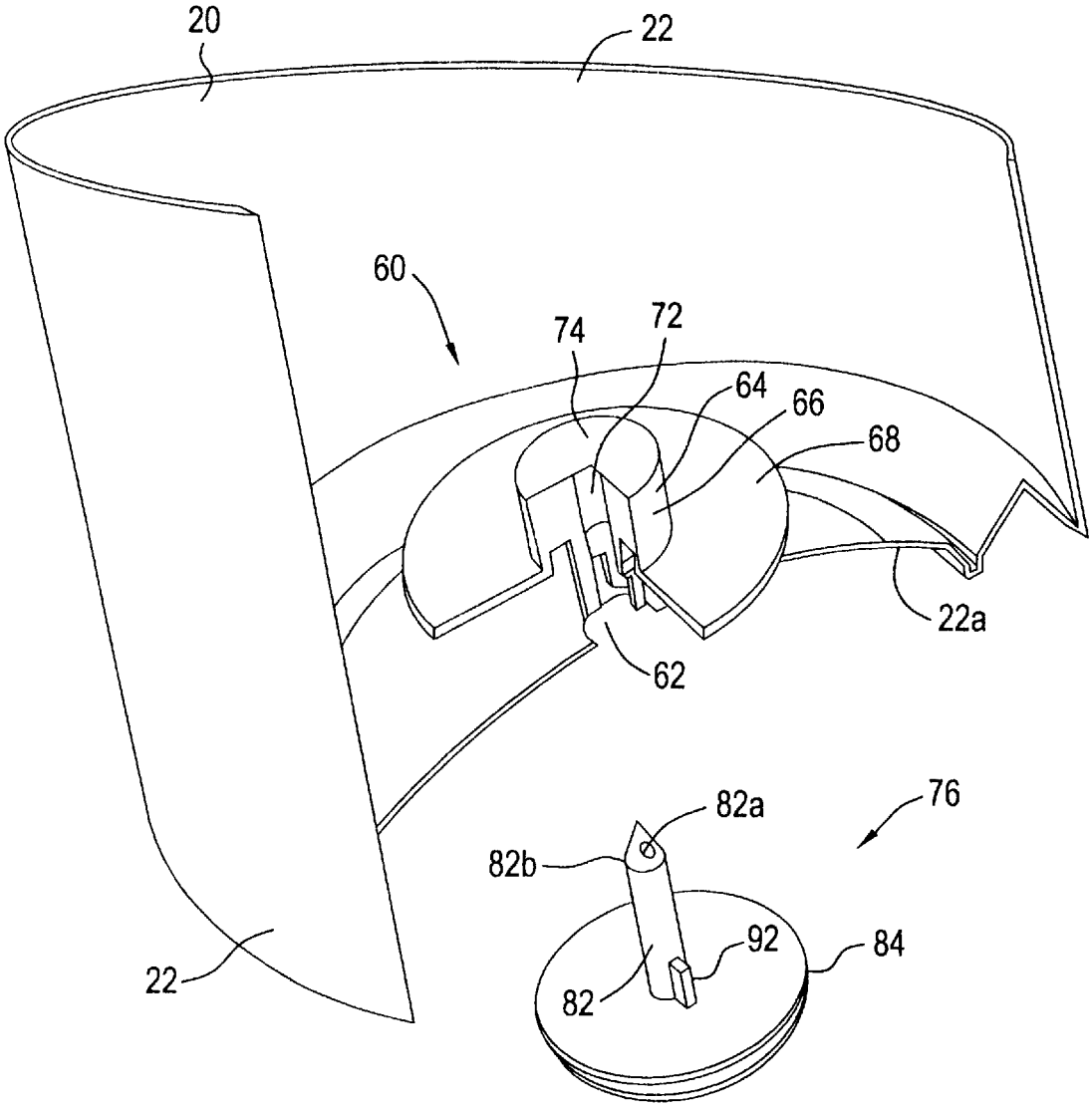
FIG. 24 is a close-up, cut away view of the bottom of the container and the refrigerant release mechanism.
Figure 25:
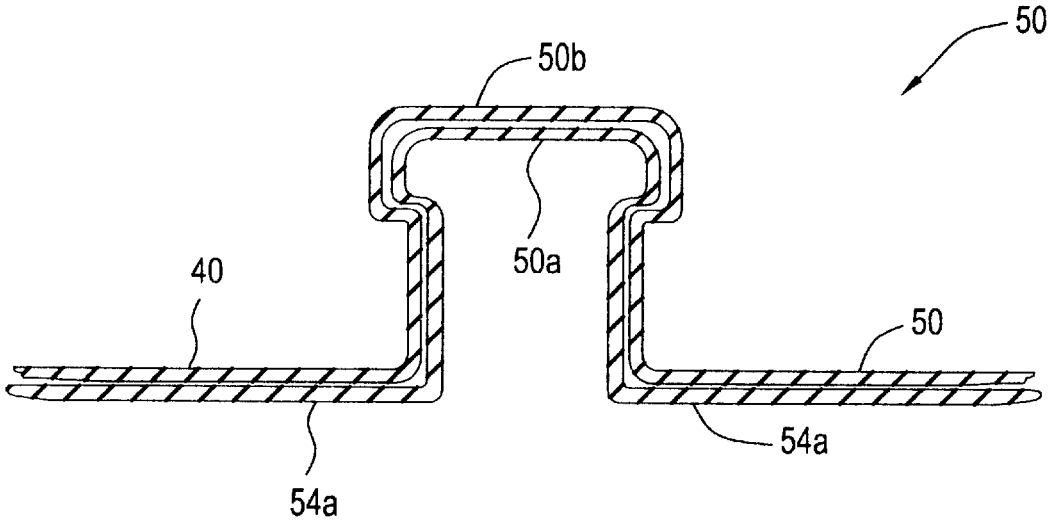
FIG. 25 is a cross-sectional side view of the center of the lid, showing in close-up detail the structure of the inventive, leak free rivet holding the trap door arm to the lid.

Referring to FIGS. 1–25, a self-cooling container apparatus 10 containing a beverage or other food item 12 is disclosed, as well as apparatus 10 assembly and operation methods.

Apparatus 10 includes an outer container 20 such as a can or a bottle having a conventional unified bottom and side container 20 wall 22 terminating in a container rim 24 defining a container opening 26. A beverage retaining secondary vessel 30 is provided within container 20 including a unified bottom and side vessel wall 34 having at least one reversible bulge 36 which protrudes into vessel 30 to permit close fitting vessel 30 insertion through the 25 container opening 26 and into container 20 during manufacture, and which is caused to reverse direction and protrude outwardly from vessel 30 after such insertion to maximize beverage 12 retaining capacity and to increase vessel 30 heat transfer surface area. Vessel 30 has a vessel sealing flange, hereinafter referred to as a vessel rim 38, defining a vessel opening 14. Vessel rim 38 extends laterally from vessel wall 34 and rests on top of container rim 24. A narrow annular refrigerant chamber 32 is defined between the container wall 22 and vessel wall 34 containing a liquid refrigerant 28 and refrigerant 28 gas or vapor such as a mixture of hydrocarbons. The pressure of the refrigerant 28 at ambient temperature of 72 degrees Fahrenheit within annular refrigerant chamber 32 has been experimentally estimated to be in the range of 20 psi (pounds per square inch) for a non-carbonated beverage 12 to 80 psi for a highly carbonated beverage 12 (one containing three volumes of $CO_2$ or more).

Several reversible bulges 36 are preferably provided in vessel wall 34. Bulges 36 optionally have tetrahedral, truncated pyramid, truncated cone, multifaceted geometric pattern shapes or folds, or any other suitable shape. The important common structural characteristic of these bulge 36 shapes is that they have an inwardly tapered topography so that the walls of the bulge 36 are easily caused to protrude inwardly within vessel 30 through suction or by mechanical means or by orientation during molding, and to protrude outwardly from vessel 30 through delivery of above-atmospheric pressure into vessel 30. Absent inward tapering of bulge 36 sides from the vessel wall 34, the bulges 36 would be damaged by creasing and crimping during direction reversal and would present much higher mechanical resistance to reversal.

A can lid 40 is provided having a lid opener mechanism 42 and a lid lateral edge 44 which is sealingly secured to the container rim 24 and the vessel rim 38, such as by seaming or by crimping them together. The term "sealingly secured" is hereinafter understood to generically refer to seaming, crimping and any other suitable lid 40 securing means or method. Lid opener mechanism 42 preferably includes a lid beverage port 46, a trap door 48 in the form of an inverted dish, sized and positioned to fit snugly into port 46, and having a radially extending lip 52 for sealingly abutting the lid 40 interior surface surrounding port 46. Trap door 48 also includes a door pivot arm 54 extending along the lid 40 interior surface to an arm fulcrum end 54*a* which is connected to lid 40 with a rivet 50. Rivet 50 preferably is formed by placing door pivot arm fulcrum end 54*a* against the center of the lid 40 interior surface. Then a cylindrical shaft positioned perpendicular to the lid 40 is driven into arm fulcrum end 54*a* and lid 40, so that a mutual tubular indentation is formed in the lid 40 and arm fulcrum end 54*a*, such that the impact of the cylindrical shaft causes the tubular indentation to bulge or bow outwardly at its closed bottom end. This configuration keeps the resulting arm upward bulge 50*a* in pivot arm 54 fitted into the resulting lid upward bulge 50*b*. This inventive construction requires no rivet passing hole in lid 40 and thus assures that beverage 12 cannot escape at rivet 50. Trap door 48 is held in sealing relationship with lid 40 in part by the pressure of beverage 12 against its interior surface, pressing its radially extending lip 52 against the lid 40 interior surface. The beverage 12 pressure against trap door 48 is of a magnitude that prevents the user from opening trap door 48 until after the release of refrigerant 28 through a refrigerant release mechanism 60. The minimum pressure resistance to opening to opening trap door 48 should be four pounds, and the size of the interior surface area of trap door 48 is selected during design and manufacture to assure such a minimum resistance to opening. This is important because the apparatus 10 would typically be turned upside down to operate refrigerant release mechanism 60, and if trap door 48 were opened first, the beverage contents 12 would spill.

Stretchable sanitizing tape 56 is preferably adhesively secured over and onto the trap door 48 exterior surface and extends over lid 40 away from beverage port 46. Tape 56 readily stretches to permit the trap door 48 to be depressed into container 20 with minimal effort and with the tape 56 unbroken. Tape 56 permits the user to open trap door 48 with dirty fingers and then, upon removal of the tape 56 together with any deposited on it to pour beverage out of container 20 over a clean trap door 48 and lid 40 upper surface immediately surrounding port 46. Tape 56 is preferably made of plastic, paper or aluminum foil.

Refrigerant release mechanism 60 is preferably located at the center of the container wall bottom portion 22*a*, this bottom portion 22*a* preferably being sufficiently concave to prevent contact of refrigerant release mechanism 60 with a container 20 support surface such as a table. Refrigerant release mechanism 60 is preferably a piercing valve including a mounting port 62 in bottom portion 22*a* fitted with a plug structure 64 having a lower cylindrical portion 66 fitted longitudinally into mounting port 62 and having a lateral radial flange 68 extending sealingly over the interior surface of bottom portion 22*a* around port 62, and having an axial bore 72 closed by a dam wall 74. An upper portion of cylindrical portion 66 preferably fits loosely into an upwardly protruding well 78 formed in the bottom of vessel 30, with sufficient space between the well 78 and the upper cylindrical portion 66 to permit refrigerant 28 to flow through during refrigerant release. See FIG. 10. A puncturing structure 76 is provided, which has generally the shape of a common thumb tack with a tubular needle portion 82 defining an axial refrigerant passageway 82*a* opening through a disk head portion 84 and with a sharpened needle free end 82*b*. Needle portion 82 fits snugly into axial bore 72 and is of sufficient length that the sharpened free end 82*b* of needle portion 82 abuts dam wall 74 while the disk head portion 84 is spaced apart from the cylindrical portion 66 exterior surface. As a result of this construction and spacing, pressure applied by a user thumb drives disk head portion 84 against the cylindrical portion 66 and drives needle portion 82 piercingly through dam wall 74 so that the refrigerant 28 gas escapes into the surrounding atmosphere through needle and head portions 82 and 84, respectively. Longitudinally extending needle portion guide splines 92 preferably slide within longitudinally extending cylindrical portion guide slots 94.

One benefit of the vessel 30 within a container 20 defining an annular refrigerant chamber 32 is that, when the refrigerant 28 is released, apparatus 10 acts as a thermos, keeping food item 12 cool and the hand contact surface of container 20 comfortably near ambient temperature. The annular refrigerant chamber 32 is at that point filled with air, which has excellent heat insulation properties.

It is noted that container 20, as well as vessel 30, can be manufactured by injection molding, blow molding, thermoforming or vacuum forming. It can be a spun or pressed container 20 made out of aluminum material.

Method of Operation

The user holds and inverts apparatus 10 so that apparatus 10 is upside down and container bottom wall portion 22*a* is at the top. Then the user presses a finger or thumb against disk head portion 84, and tubular needle 82 pierces dam wall 74 so that refrigerant boils into refrigerant 28 gas and the gas escapes from annular refrigerant chamber 32 through needle 82 into the atmosphere. Then apparatus 10 is again inverted to become right side up with lid 40 at the top. The release of refrigerant 28 diminishes vessel contents pressure against the interior surface of trap door 48, so that trap door 48 may be opened by pressing a finger or thumb against its outer surface. Opening refrigerant release mechanism 60 releases the refrigerant 28 vapor initially present within annular refrigerant chamber 32, and the remaining pressurized liquid refrigerant 28 progressively boils into a vapor state, gathering heat from the beverage 12 through vessel wall 34, and rapidly escapes through release mechanism 60, thereby carrying heat away and cooling the beverage 12. As refrigerant 28 boils and evaporates, it draws heat out of the beverage 12 through vessel wall 34, cooling beverage 12. Once all of the refrigerant 28 has been released, apparatus 10 is re-oriented into its upright position and lid opener mechanism 42 is operated to permit beverage 12 to flow out of vessel 30 and container 20 through beverage port 46.

Method of Manufacture

In practicing the invention, the following method may be used. The bulges 36 are bowed inwardly in vessel 30, to minimize the maximum radial width of vessel 30, such as by creating a pressure within vessel 30 which is sufficiently less than the pressure against the exterior of vessel 30 that bulges 36 are forced into their inwardly protruding mode. Alternatively, bulges 36 are mechanically pushed inward or are simply manufactured in their inwardly protruding mode. See FIGS. 5, 6, 7, 9 and 11. Then vessel 30 is inserted through the container opening 26 and the neck, if any, of container 20, which is preferably a very close fit to maximize the beverage retaining volume of vessel 30 for a given container 20. Then pressure is created within vessel 30 sufficiently greater than the pressure surrounding vessel 30 that bulges 36 are forced into their outwardly protruding mode. This outwardly protruding bulge 36 configuration increases vessel wall 34 surface area for enhanced heat transfer between refrigerant 28 and the flowable food item 12 and for increased food item 12 volume. See FIGS. 1, 2, 3, 10 and 12. Then beverage 12 is poured into vessel 30, substantially filling vessel 30, and lid 40 is sealingly crimped onto vessel rim 38 and container rim 24. Apparatus 10 and its flowable food item 12 contents then go through the normal process in a beverage plant such as inversion leak tests, surface humidity removal chamber, labeling, and weight check, before going into a refrigerant filling station. Liquid refrigerant 28 is then pumped into the annular refrigerant chamber 32 through mounting port 62, around the loose, lower plug portion 66 of plug structure 64 and between lateral radial flange 68 and container bottom wall portion 22*a*, and plug structure 64 is sealingly inserted into mounting port 62. This sealing insertion of plug structure 64 into mounting port 62 pressing lateral radial flange 68 sealingly against container bottom wall portion 22*a* may be caused by the pressure of refrigerant 28 against lateral radial flange 68, pressing radial flange 68 into sealing relation with the inner surface of container bottom wall 22*a* surrounding mounting port 62, or may be caused by external mechanical means. As the refrigerant 28 approaches ambient temperature, its pressure rises substantially, bearing against vessel wall 34 and in turn against beverage 12, which in turn bears against lid 40 and trap door 48, so that equilibration of pressure is reached within a few minutes or less. The pressure of refrigerant 28 does not collapse vessel 30 and does not bow bulges 36 inwardly, however, because any liquid or otherwise flowable food item, such as a beverage, is compressible only to an extent inconsequential to the operation of apparatus 10.

It is noted that treatment of the can version of apparatus 10, and to a large extent treatment of the bottle version, during beverage filling and lid 40 seaming or crimping is the same as for any other can. In the instance of a can, the apparatus 10 is filled and the lid 40 secured by common, already-existing canning plant equipment on a common, already-existing assembly line. Lid 40 is seamed to the apparatus 10 rims with a standard beverage seamer, such as a COMACO™ or an ANGELES™ seamer.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A rapid refrigeration apparatus comprising:

a container having a container upper end, a container wall with a container opening in said container upper end bordered by a container rim;

a beverage retaining vessel extending within said container defining a substantially annular refrigerant chamber between said container and said vessel containing a liquified refrigerant with refrigerant vapor, and said vessel containing flowable vessel contents, said vessel being sized to fit at least partly through said container opening, said vessel comprising a vessel rim secured relative to said container rim, and a vessel wall comprising at least one reversible bulge;

lid means sealingly secured to said container rim and comprising lid opener means for releasing said vessel contents from said vessel and container for consumption; said lid opener means comprising a lid opener means activation means for voluntarily opening said lid opener means at a selected moment in time subsequent to refrigerant release;

and refrigerant release means for releasing said refrigerant from said annular chamber; said refrigerant release means comprising a refrigerant release means activation means for voluntarily opening said refrigerant release means at a selected moment in time, thereby causing said refrigerant to boil into refrigerant vapor and escape into the atmosphere surrounding said apparatus, thereby cooling the vessel contents.

2. An apparatus according to claim 1, wherein said lid has a lid interior surface and a lid exterior surface and wherein said lid opener means comprises:

a lid beverage port;

a trap door in the general shape of an inverted dish having a door interior surface and a door exterior surface, positioned to fit into said lid beverage port and having a radially extending door lip for making sealing abutment with the interior surface of said lid surrounding said lid beverage port and a door pivot arm having an arm fulcrum end and extending along the interior surface of said lid to said arm fulcrum end, said arm fulcrum end being connected to said lid with door fastening means;

wherein said trap door is held in sealing relationship with said lid at least in part by the pressure of said vessel contents against the interior surface of said door pressing said radially extending lip against said lid interior surface, and wherein the pressure of said vessel contents against said door interior surface together with the interior surface area of said door creates a force against said door of a magnitude of at least four pounds, such that said door resists manual opening by a user until after the opening of said refrigerant release means and the subsequent boiling of said refrigerant into refrigerant vapor and the release of said refrigerant vapor into the atmosphere.

3. An apparatus according to claim 2, wherein said door fastening means comprises an arm bulge in said pivot arm which is press-fitted into a lid bulge, such that no rivet passing opening is provided through which said refrigerant might escape.

4. An apparatus according to claim 1, wherein said lid opener means additionally comprises stretchable sanitizing tape adhesively secured over and onto the exterior surface of said trap door and extends over said lid near said beverage port, wherein said tape readily stretches to permit said trap door to be depressed into said container with minimal resistance;

such that said tape permits the user to open said trap door with dirty fingers and then, upon removal of said tape together with any dirt deposited onto it, to pour beverage out of said container over a clean said trap door.

5. An apparatus according to claim 1, wherein said refrigerant release means is located at the center of the bottom portion of said container wall, said bottom portion being sufficiently concave to prevent contact of said refrigerant release means with a container support surface.

6. An apparatus according to claim 5, wherein said refrigerant release means comprises:

a mounting port in said container wall bottom portion fitted with a plug structure having a plug cylindrical portion fitted longitudinally into said mounting port and having a lateral plug radial flange extending sealingly over the interior surface of said container wall bottom portion around said mounting port, said plug structure having an axial bore closed by a dam wall;

and a puncturing structure comprising a head portion and a tubular needle portion extending from said head portion, said needle portion having a sharpened needle free end defining an axial refrigerant passageway opening through said head portion; wherein said needle portion fits into said axial bore and is of sufficient length that said sharpened free end of said needle portion can abut said dam wall while said disk head portion is spaced apart from said plug cylindrical portion;

such that manual pressure applied by a user drives said head portion against said plug cylindrical portion and drives said needle portion piercingly through said dam wall such that said refrigerant vapor escapes into the atmosphere surrounding said apparatus through said axial bore.

7. An apparatus according to claim 6, additionally comprising at least one longitudinally extending needle portion guide spline slidably retained within a longitudinally extending cylindrical portion guide slot.

8. A rapid refrigeration apparatus comprising:

a container having a container upper end, a container wall with a container opening in said container upper end bordered by a container rim and a beverage retaining vessel extending within said container defining an annular refrigerant chamber between said container and said vessel containing a liquified refrigerant and refrigerant vapor, and said vessel containing flowable vessel contents;

lid means sealingly secured to said container rim and comprising lid opener means for releasing said vessel contents from said vessel and container for consumption; said lid opener means comprising a lid opener means activation means for voluntarily opening said lid opener means at a selected moment in time, wherein said lid has a lid interior surface and a lid exterior surface and wherein lid opener means comprises a lid beverage port; a trap door in the general shape of an inverted dish having a door interior surface and a door exterior surface, sized and positioned to fit into said lid beverage port and having a radially extending door lip for making sealing abutment with the interior surface of said lid surrounding said lid beverage port and a door pivot arm having an arm fulcrum end and extending along the interior surface of said lid to said arm fulcrum end, said arm fulcrum end being connected to said lid with door fastening means, wherein said trap door is held in sealing relationship with said lid at least in part by the pressure of said vessel contents against the interior surface of said door pressing said radially extending lip against said lid interior surface, and wherein the pressure of said vessel contents against said door interior surface is of a magnitude that prevents the user from opening said trap door until after the release of said refrigerant through said refrigerant release means;

and refrigerant release means for releasing said refrigerant from said annular chamber; said refrigerant release means comprising a refrigerant release means activation means for voluntarily opening said refrigerant release means at a selected moment in time, thereby causing said refrigerant to boil into refrigerant vapor and escape into the atmosphere surrounding said apparatus, thereby cooling the vessel contents.

9. An apparatus according to claim 8, wherein said lid opener means additionally comprises stretchable sanitizing tape adhesively secured over and onto the exterior surface of said trap door and extends over said lid near said beverage port, wherein said tape readily stretches to permit said trap door to be depressed into said container with minimal resistance;

such that said tape permits the user to open said trap door with dirty fingers and then, upon removal of said tape together with any dirt deposited onto it, to pour beverage out of said container over a clean said trap door.

10. A rapid refrigeration apparatus comprising:

a container having a container upper end, a container wall with a container opening in said container upper end bordered by a container rim;

a beverage retaining vessel extending within said container defining an annular refrigerant chamber between said container and said vessel containing a refrigerant, and said vessel containing flowable vessel contents;

lid means sealingly secured to said container rim flange and comprising lid opener means for releasing said vessel contents from said vessel and container for consumption; said lid opener means comprising a lid opener means activation means for voluntarily opening said lid opener means at a selected moment in time;

and refrigerant release means for releasing said refrigerant from said annular chamber into the atmosphere surrounding said apparatus; said refrigerant release means comprising a mounting port in said container wall bottom portion fitted with a plug structure having a plug cylindrical portion fitted longitudinally into said mounting port and having a lateral plug radial flange extending sealingly over the interior surface of said container wall bottom portion around said mounting port, said plug structure having an axial bore closed by a dam wall, and a puncturing structure comprising a head portion and a tubular needle portion extending from said head portion, said needle portion having a sharpened needle free end defining an axial refrigerant passageway opening through said head portion; wherein said needle portion fits into said axial bore and is of sufficient length that said sharpened free end of said needle portion can abut said dam wall while said disk head portion is spaced apart from said plug cylindrical portion;

such that manual pressure applied by a user drives said head portion against said plug cylindrical portion and drives said needle portion piercingly through said dam wall such that said refrigerant vapor escapes into the atmosphere surrounding said apparatus through said axial bore.

11. A rapid refrigeration apparatus comprising:

a container having a container upper end, a container wall with a container opening in said container upper end bordered by a container rim;

a beverage retaining vessel extending within said container defining a substantially annular refrigerant chamber between said container and said vessel containing a refrigerant, and said vessel containing flowable vessel contents, said vessel being sized to fit at least partly through said container opening, said vessel comprising a vessel rim secured relative to said container rim, and a vessel wall comprising at least one reversible bulge;

lid means removably and sealingly secured to said container rim;

and refrigerant release means for releasing said refrigerant from said annular chamber into the atmosphere surrounding said apparatus; said refrigerant release means comprising a refrigerant release means activation means for voluntarily opening said refrigerant release means at a selected moment in time.

12. A method of operating a rapid refrigeration apparatus comprising a container having a container upper end, a container wall with a container opening in said container upper end bordered by a container rim; a beverage retaining vessel extending within said container defining a substantially annular refrigerant chamber between said container and said vessel containing a liquified refrigerant with refrigerant vapor, and said vessel containing flowable vessel contents, said vessel being sized to fit at least partly through said container opening, said vessel comprising a vessel rim secured relative to said container rim, and a vessel wall comprising at least one reversible bulge; lid means sealingly secured to said container rim and comprising lid opener means for releasing said vessel contents from said vessel and container for consumption; said lid opener means comprising a lid opener means activation means for voluntarily opening said lid opener means at a selected moment in time subsequent to refrigerant release; and refrigerant release means for releasing said refrigerant from said annular chamber; said refrigerant release means comprising a refrigerant release means activation means for voluntarily opening said refrigerant release means at a selected moment in time, thereby causing said refrigerant to boil into refrigerant vapor and escape into the atmosphere surrounding said apparatus, thereby cooling the vessel contents; comprising the steps of:

inverting said apparatus such that said refrigerant release means is at the top of said apparatus;

operating said refrigerant release means to cause said liquid refrigerant boil into refrigerant vapor and escape from said annular refrigerant chamber into the atmosphere surrounding said apparatus and to thereby diminish pressure of said vessel contents against said trap door;

inverting said apparatus once again such that said lid opener means is at the top of said apparatus;

and operating said lid opener means to open said trap door to permit said vessel contents to flow out of said apparatus.

* * * * *